US009777505B2

(12) United States Patent
Sprung

(10) Patent No.: US 9,777,505 B2
(45) Date of Patent: Oct. 3, 2017

(54) DOOR SYSTEM FOR MOVABLE STRUCTURES

(71) Applicant: SPRUNG INSTANT STRUCTURES LTD., Aldersyde, Alberta (CA)

(72) Inventor: Philip D. Sprung, Aldersyde (CA)

(73) Assignee: SPRUNG INSTANT STRUCTURES LTD., Aldersyde, Alberta (CA)

( * ) Notice: Subject to any disclaimer, the term of this patent is extended or adjusted under 35 U.S.C. 154(b) by 0 days.

(21) Appl. No.: 14/884,485

(22) Filed: Oct. 15, 2015

(65) Prior Publication Data

US 2017/0107738 A1 Apr. 20, 2017

(51) Int. Cl.

| | |
|---|---|
| ***E04H 15/38*** | (2006.01) |
| ***E04H 15/18*** | (2006.01) |
| ***E04H 15/32*** | (2006.01) |
| ***E04H 15/40*** | (2006.01) |
| ***E04H 15/54*** | (2006.01) |
| ***E04H 15/58*** | (2006.01) |

(52) U.S. Cl.

CPC ..... *E04H 15/38* (2013.01); *E04H 15/18* (2013.01); *E04H 15/322* (2013.01); *E04H 15/405* (2013.01); *E04H 15/54* (2013.01); *E04H 15/58* (2013.01)

(58) Field of Classification Search

CPC ..... E04H 15/58; E04H 15/38; E04H 6/04
USPC ..... 135/133, 132, 906, 136; 52/63
See application file for complete search history.

(56) References Cited

U.S. PATENT DOCUMENTS

| | | | | |
|---|---|---|---|---|
| 2,806,477 A | | 9/1957 | Fritsche | |
| 3,470,659 A | * | 10/1969 | De Koning | E04H 6/04 160/132 |
| 3,563,257 A | * | 2/1971 | Cummins | B64F 1/005 135/131 |
| 3,820,553 A | * | 6/1974 | Huddle | E04H 15/18 135/117 |
| 3,958,588 A | | 5/1976 | Huddle | |

(Continued)

FOREIGN PATENT DOCUMENTS

| | | | | |
|---|---|---|---|---|
| CA | 2018294 C | * | 1/1993 | E04H 6/04 |
| CN | 203097413 U | | 7/2013 | |

(Continued)

OTHER PUBLICATIONS

International Search Report and Written Opinion for International Patent Application No. PCT/CA2016/051194 dated Dec. 28, 2016.

*Primary Examiner* — Noah Chandler Hawk
(74) *Attorney, Agent, or Firm* — Moore & Van Allen PLLC; Henry B. Ward, III

(57) ABSTRACT

The present invention provides a door system for a temporary, movable structure having a plurality of spaced apart frame members and a membrane stretched between adjacent frame members. The door system has multiple modules movable between open and closed positions. Each module has its own membrane, separate from the membranes of the structure, which is stretched taught over the surface of the module. In the open position, the modules do not obstruct the opening in the structure, and the membranes of the modules and the structure do not go slack. The membranes of both the structure and the modules are always under tension, thus being less susceptible to damage.

19 Claims, 23 Drawing Sheets

(56) References Cited

U.S. PATENT DOCUMENTS

| | | | | | |
|---|---|---|---|---|---|
| 4,583,331 | A * | 4/1986 | Hunt | E04H 15/18 | 135/132 |
| 4,885,877 | A * | 12/1989 | Hunt | E04H 15/644 | 135/132 |
| 4,886,083 | A | 12/1989 | Gamache | | |
| 5,086,799 | A * | 2/1992 | Lumbleau | B63B 59/00 | 135/90 |
| 5,146,722 | A * | 9/1992 | Stafford | E04H 15/322 | 135/137 |
| 5,283,993 | A | 2/1994 | Sprung | | |
| 5,390,688 | A | 2/1995 | Lipman | | |
| 5,740,828 | A * | 4/1998 | Evans | E04H 15/38 | 135/132 |
| 6,052,951 | A * | 4/2000 | Daoud | E04H 15/38 | 52/64 |
| 6,112,756 | A | 9/2000 | Tseng | | |
| 6,763,842 | B2 * | 7/2004 | Blount | E04H 15/38 | 135/131 |
| 6,786,171 | B1 | 9/2004 | Elbers | | |
| 8,752,881 | B2 | 6/2014 | Chenowth | | |
| 8,967,172 | B2 * | 3/2015 | Ying | E04H 15/40 | 135/129 |
| 2010/0126546 | A1 * | 5/2010 | Chen | E04H 15/38 | 135/126 |
| 2016/0176277 | A1 * | 6/2016 | Deal | E04H 15/38 | 135/136 |

FOREIGN PATENT DOCUMENTS

| | | | | |
|---|---|---|---|---|
| CN | 103669987 | A | 3/2014 | |
| DE | 19711356 | A1 | 10/1998 | |
| GB | 2354019 | A * | 3/2001 | E04H 6/04 |
| KR | 20130131506 | A | 12/2013 | |
| WO | 2007019633 | A1 | 2/2007 | |

* cited by examiner

DOOR SYSTEM FOR MOVABLE STRUCTURES

FIELD OF INVENTION

The invention relates to movable structures generally, and particularly to doors for such structures.

BACKGROUND

Many types of temporary, movable structures are known in the art. One kind of movable structure comprises a plurality of spaced apart frame members, such as arches, and a membrane stretched over the frame members to create an interior space underneath.

Such structures can have many different types of doors to allow access to the interior space. One type of door known in the art is a so-called "clamshell" door, in which a rounded end of the structure is rotated upward, providing access to the interior space of the structure. Clamshell doors can be implemented by providing a frame member that forms a rounded surface at one end (or both ends) of the structure. The frame member is movable between a closed position, in which the rounded surface closes off an opening to the structure, and an open position, in which the frame member is moved upwardly and either collapses into a compressed position adjacent to one of the plurality of arches, or is positioned above the structure. In either case, in the open position the rounded surface created by the frame member does not close off the opening to the structure. To complete the clamshell door, the membrane of the structure is extended over the rounded surface formed by the frame member when the frame member is in the closed position.

One problem with known clamshell doors for movable structures is that the membrane covering the clamshell door is untensioned, and allowed to drape or baffle when the door is opened. Slack in the membrane is a problem because it makes the membrane much more susceptible to damage. This problem is magnified in structures deployed in hot climates, where the clamshell door is often kept in the open position, with a slack membrane, for extended periods of time. Under such conditions, the useful life expectancy of the membrane is greatly reduced, often by as much as 90%. This problem also is prevalent in cold climates, where the slack membrane is susceptible to cold cracking.

SUMMARY OF THE INVENTION

The present invention provides a clamshell-type door for a temporary, movable structure having multiple modules movable between open and closed positions. Each module has its own membrane, separate from the membranes of the structure, which is stretched taught over the surface of the module. In the open position, the modules are nested one under another in an essentially vertical position, uncovering the entire opening in the end of the structure. In this way, the membranes of both the structure and the modules are always under tension; the membranes are never slack and more susceptible to damage.

In one embodiment of the invention, there is provided a door system for a movable structure, the movable structure comprising a plurality of spaced apart frame members and at least one tensioned structure membrane extending between at least two of the spaced apart frame members and forming an interior space under the spaced apart frame members, the interior space having at least one open end. The door system for the movable structure comprises first and second axles arranged coaxially and attached to the structure at first and second sides of the open end of the interior space, a first door module, and a second door module. The first door module comprises a first frame extending from a first end of the first frame hingedly attached to the first axle, to a second end of the first frame hingedly attached to the second axle, and a first tensioned door membrane supported by the first frame. The second door module comprises a second frame extending from a first end of the second frame hingedly attached to the first axle adjacent to the first end of the first frame, to a second end of the second frame hingedly attached to the second axle adjacent to the second end of the first frame, and a second tensioned door membrane supported by the second frame. The first and second door modules are rotatable about the first and second axles between a closed position in which the first door module extends across an upper portion of the open end and the second door module extends across a lower portion of the open end, and an open position in which the open end of the interior space is substantially unobstructed by the first and second door modules.

In one embodiment, the door system further comprises a system for rotating the first and second door modules about the first and second axes.

In one embodiment, the system for rotating the first and second door modules comprises at least one cable attached at one end to the second door module, and at the other end to a winch for selectively extending or retracting the cable and raising or lowering the second door module.

In one embodiment, the door system further comprises a cable extending from a first cable end attached to the first door module to a second cable end attached to one of the plurality of spaced apart frame members. The cable is adapted to hold the first door module in its closed position extending across the upper portion of the open end of the interior space.

In one embodiment, the first and second door modules are adapted to make contact with each other when the second door module is being rotated from the closed position to the open position, to move the first door module from the closed position to the open position.

In one embodiment, a plurality of arms extend from the first door module, the plurality of arms being adapted to make contact with the second door module when the second door module is being rotated from the closed position to the open position, to move the first door module from the closed position to the open position.

In one embodiment, the first and second door modules are rotatable about the first and second axles to a partially open position wherein the second door module extends across the upper portion of the open end, and the lower portion of the open end is substantially unobstructed by the second door module.

In one embodiment, the first and second frames of the first and second door modules each comprise a plurality of arch members extending from the first end of the frame to the second end of the frame. The plurality of arch members are spaced apart between the first and second ends, and the first and second frames each further comprise a plurality of spreader members extending between the plurality of arch members.

In one embodiment, the first and second frames further comprise a plurality of cross spreader members extending substantially diagonally between connections points between the arch members and the spreader members. The plurality of cross spreader members provides bracing between the spreader members.

In one embodiment, the system further comprises a locking mechanism for holding the first and second door modules in the closed position. In one embodiment, the locking mechanism comprises an articulated arm pivotally mounted to the second door module, the articulated arm being adapted to make contact with an attachment point on a surface on which the movable structure is erected, for holding the second door module in the closed position.

In one embodiment, the system further comprises a pair of catches, one of said pair of catches provided on each of the first door module and second door module, the catches adapted to interlock with one another and hold the first door module in the closed position when the second door module is in the closed position.

In another embodiment of the invention, there is provided a kit of parts for a door system for a movable structure. The kit comprises a first frame for supporting a membrane, the first frame extending from a first end of the first frame to a second end of the first frame. The kit also comprises a second frame for supporting a membrane, the second frame extending from a first end of the second frame to a second end of the second frame, wherein a distance from the first end of the second frame to the second end of the second frame is less than a distance from the first end of the first frame to the second end of the first frame. The kit further comprises first and second membranes to be tensioned and supported by the first and second frames, respectively. The kit further comprises first and second axles for hingedly supporting the first and second ends, respectively of the first and second frames.

In one embodiment, the kit further includes at least one lifting cable and winch, the lifting cable for attachment at one end to the second frame and an opposite end to the winch, the winch for selectively extending or retracting the lifting cable to raise or lower the second frame.

In one embodiment, the kit further includes at least one cable for attachment at one end to the first frame and at an opposite end of the cable to the movable structure.

In one embodiment, the first frame of the kit comprises an arm adapted to contact the second frame while the second frame is in motion, to move the first frame.

In one embodiment, the first and second frames of the kit each comprise a plurality of arch members extending from the first end of the frame to the second end of the frame, the plurality of arch members being spaced apart between the first and second ends, the first and second frames each further comprising a plurality of crossbar members extending between the plurality of arch members.

In one embodiment, the first and second frames of the kit each further comprise a plurality of cross spreader members extending substantially diagonally between connection points between the arch members and the spreader members. The plurality of cross spreader members provides bracing between the spreader members.

In one embodiment the second frame comprises an articulated arm pivotally mounted thereon, the articulated arm being adapted to make contact with an attachment point, for holding the second frame adjacent to the attachment point.

In one embodiment, the first and second frames each comprise one of a pair of catches adapted to interlock with one another and hold the first and second frames adjacent to one another.

DETAILED DESCRIPTION OF EMBODIMENTS

Figure 1:
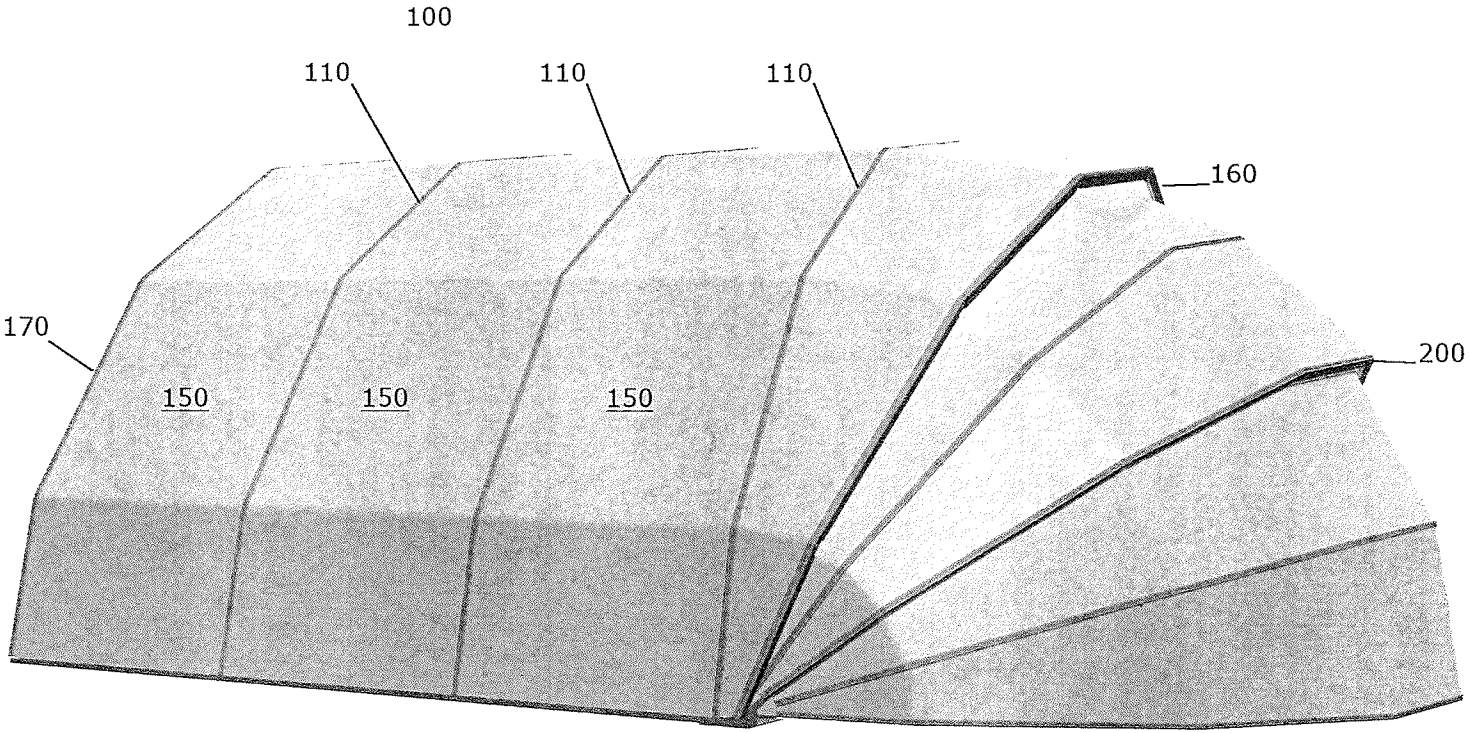
FIG. 1 is a perspective view of a movable structure having a door system according to the present invention.
Figure 2:
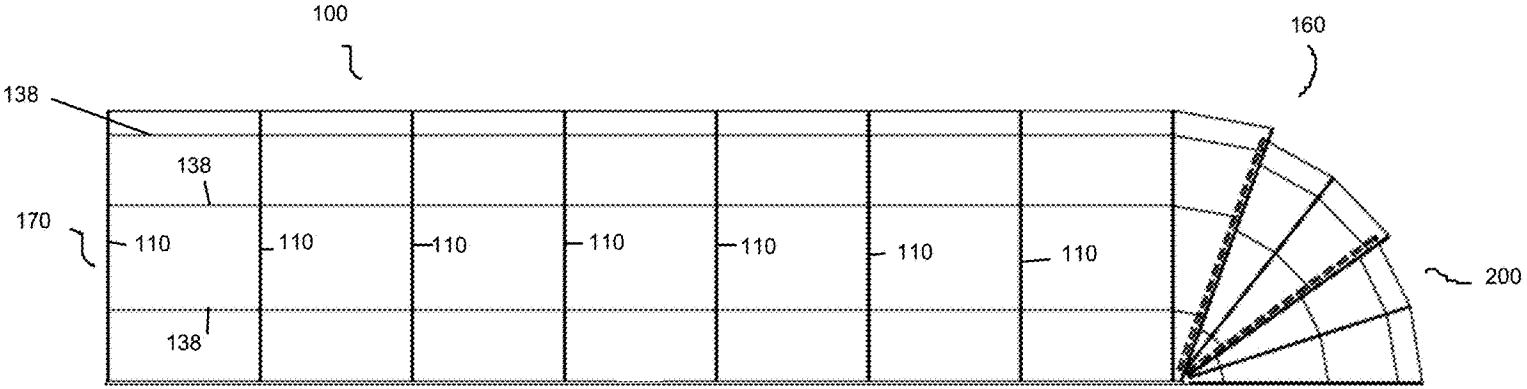
FIG. 2 is a side view of the movable structure of FIG. 1.

Example embodiments of the invention will now be described with reference to the figures. FIG. 1 depicts a movable structure 100 having a foldable door system 200 in accordance with the present invention. FIG. 2 depicts a side view of movable structure 100. The structure 100 comprises a series of arches 110 spaced apart along the length of the structure 100, acting as a frame for the structure 100. A plurality of membranes 150 (shown in FIG. 1 but not in FIG. 2 extend between the arches 110, forming an interior space within the structure 100. The membranes 150 extending between arches 110 also form open ends 160, 170 of the interior space under the membrane. In the illustrated embodiment, open end 160 is selectively closed off with the foldable door system 200 of the present invention. Open end 170 is closed off with an additional membrane (not shown).

Figure 3:
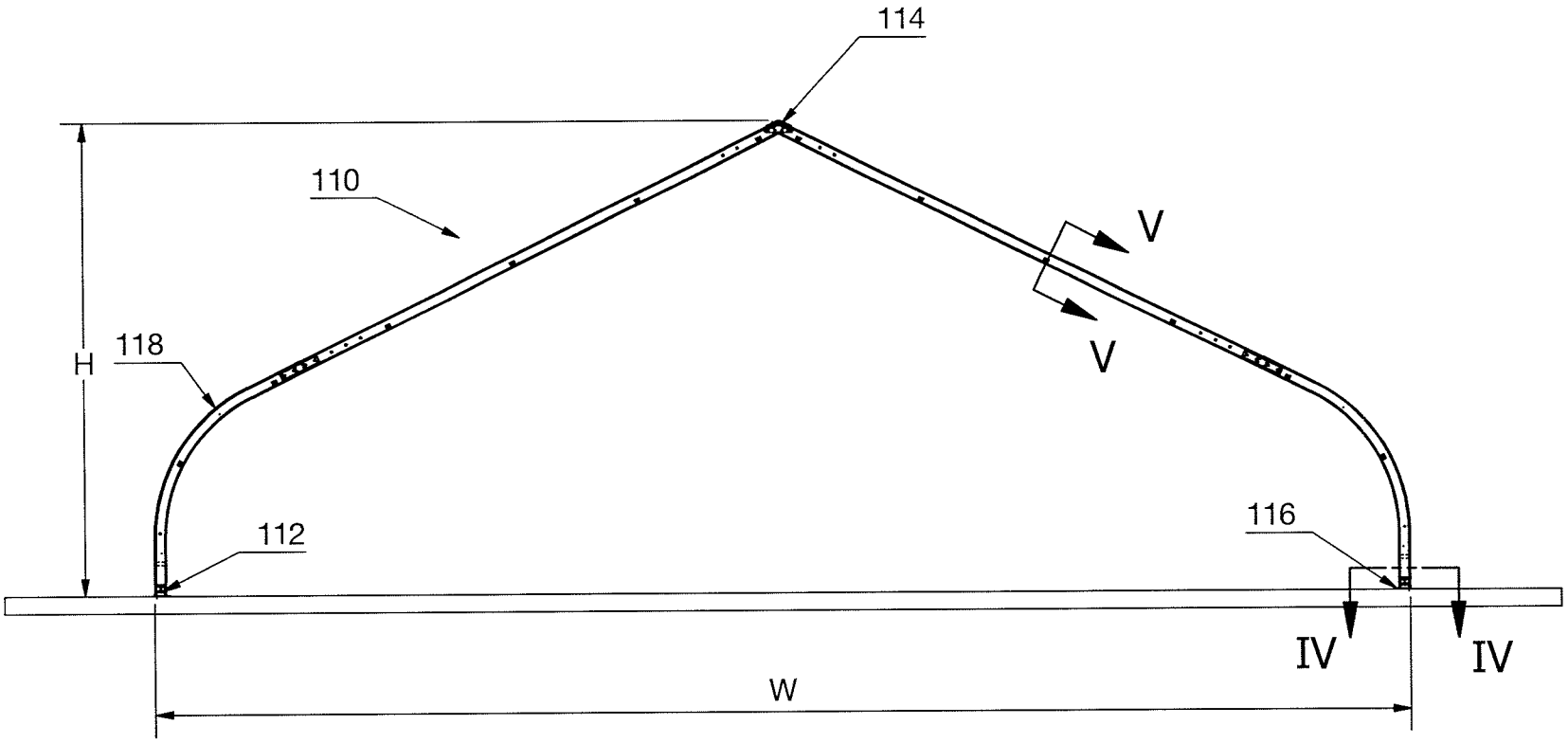
FIG. 3 is a side view of an arch used in the construction of the movable structure of FIG. 1.

Each of arches 110 extend from a first foot portion 112 to a peak 114 and back to a second foot portion 116, as shown in FIG. 3. In the example shown, the arches 110 have a span W of 90 feet, and a height H of approximately 35 feet.

Each of the arches 110 includes a plurality of beams, some curved and others substantially straight. The beams (both curved and straight) used to construct the arches 110 are shown in cross-section in FIG. 4. The beams have an I-shaped cross section, and additional features that will be described in greater detail below. The curved beams are approximately 13.4 feet in length as measured along their outer edge, and rise approximately 4 feet (again, as measured along the outer edge) from the foot portions 112, 116 before curving inwardly toward the peak 114. The straight beams extend from the end of the curved beams to the peak 114. The distance from a curve transition point 118, at which the curvature of the curved beam ends and the straight portion of the arches 110 begins, to the peak 114 is approximately 42.6 feet.

Other embodiments of the arches serving as a frame for the structure can have different dimensions and shapes than those described here. For example, the arches can be composed of a series of straight beams joined end to end at various angles to one another. For example, the arch can be formed by straight beams rising from the foot portions at an angle of 83 degrees (all angles relative to a floor of the structure), followed by beams extending therefrom at an angle of 57 degrees, followed by further beams extending at an angle of 34 degrees, followed by two final beams extending at an angle of 11 degrees and meeting at a peak.

Figure 4:
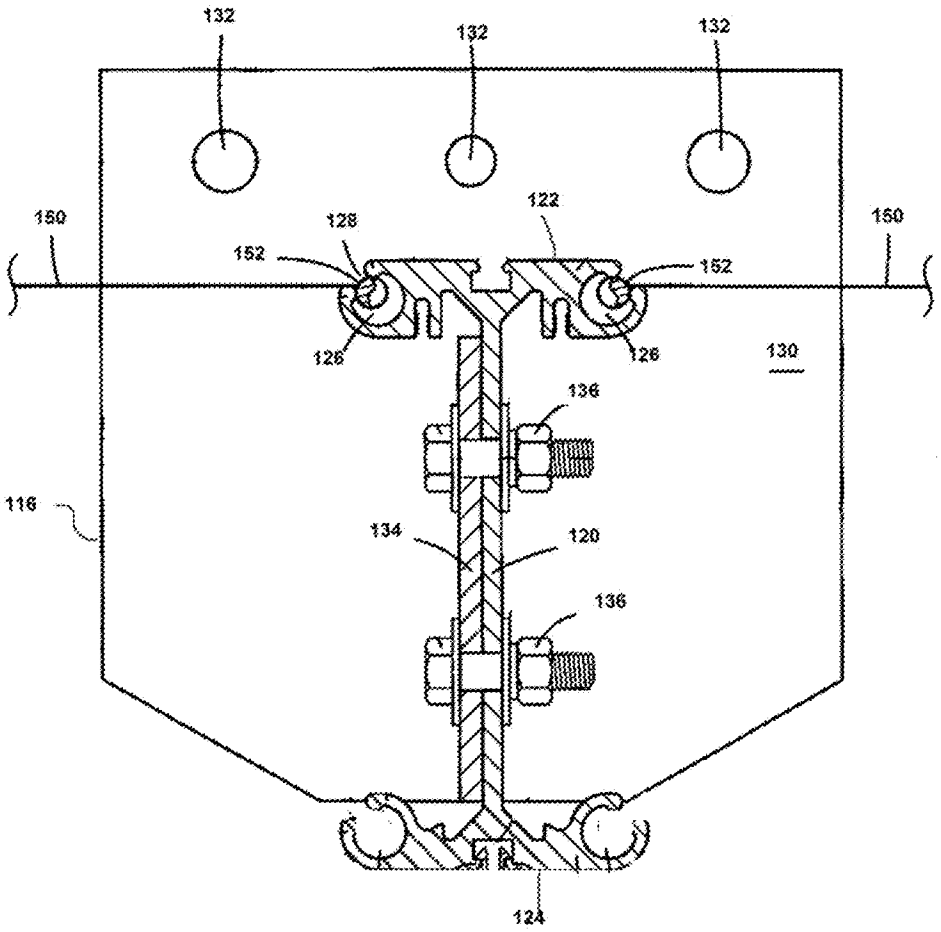
FIG. 4 is a cross-sectional view taken along the line IV-IV in FIG. 3.

As mentioned previously, the arches 110 have an I-shaped cross section, shown in FIG. 4. The arches 110 have a central web 120 with an integral first flange 122 at one end, and an integral second flange 124 at the other end. The flanges 122 and 124 have bifurcated ends that define rope chases 126 having rope chase openings 128. For reasons that will be explained in greater detail below, rope chases 126 and rope chase openings 128 are adapted to receive and retain ropes that are integral with, or otherwise attached to the longitudinal ends of membrane 150, as well as the longitudinal end of membrane 150 itself.

In the illustrated embodiment, the beams that comprise arches 110 are 5-inch by 10-inch extruded aluminum I-beams; however, it will be appreciated that other cross-sectional dimensions for the beams are possible. As well, aluminum is not the only suitable material for the production of the beams.

The second foot portion 116 from which the arches 110 extend is shown in FIG. 4. The second foot portion 116 is identical to the first foot portion 112. The second foot portion 116 comprises a base plate 130 having bolt holes 132 formed therein, to allow the base plate 130 to be secured to the ground or other level surface using anchor bolts. The second foot portion 116 further comprises an attachment flange 134 formed integrally therewith and extending substantially perpendicularly from the base plate 130. The base plate 130 can be made of aluminum or any other suitable material. In the illustrated embodiment, the base plate 130 is a 1-foot by 1-foot square with two corners absent. The base plate 130 is ⅝-inch thick, whereas the flange 134 is ⅜-inch thick. It will be understood, however, that other dimensions are possible.

Flange 134 has a pair of bolt holes extending therethrough. The bolt holes are adapted to line up with corresponding bolt holes formed in the web 120 of the arches 110. In this manner, bolts 136 can be inserted through the bolt holes in both flange 134 and web 120, securing the arch 110 to the second foot portion 116. In the illustrated embodiment, a threaded bolt and nut combination are used to fasten the arch 110 to the second foot portion 116, however other suitable fasteners can be used as well.

As seen in FIG. 2, structure 110 has a plurality of spreaders 138 extending perpendicularly between the arches 110. Spreaders 138 provided additional structural stability to arches 110, and serve to keep the membrane 150 in a stretched condition by urging adjacent arches 110 apart from each other.

Figure 5:
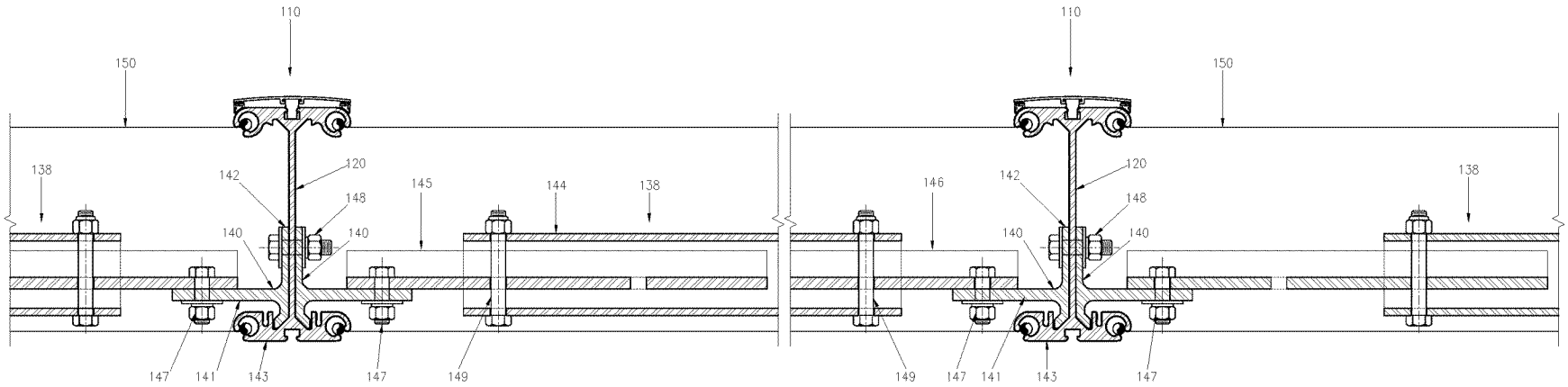
FIG. 5 is a cross-sectional view taken along the line V-V in FIG. 3.

FIG. 5 shows a cross sectional view of a portion of the roof of structure 100, taken along the line V-V shown in FIG. 3, which shows the spreaders 138 in greater detail. Spreaders 138 are attached to arches 110 by means of spreader connectors 140. Each spreader connector 140 includes an outwardly extending member 141, a flange 142 perpendicular to the member 141 and a grapple portion 143.

The spreaders 138 can comprise essentially any telescoping rod. In the illustrated embodiment, spreaders 138 include a hollow bar 144 having a square-shaped cross section and pi-shaped bars (pi-bars) 145 and 146. The pi-bars 145 and 146 are slidable within the hollow bar 144, and can extend outwardly from the hollow bar 144 to varying extents. The pi-bars 145 and 146 can be locked in place with locking mechanism 149, or any other suitable means of locking the pi-bars 145, 146 in place.

The outwardly extending ends of the pi-bars 145 and 146 attach to members 141 of the spreader connectors 140 by means of connector assemblies 147 which in the illustrated embodiment include a ⅝-inch by 2 and ¼-inch bolt, a nut and washers; however alternative connector assemblies can have differently sized mating components. The spreader connectors 140 are in turn attached to the arches 110 by means of connector assemblies 148 which extend through apertures in the flanges 142 and the web 120. The attaching means also includes channels in the second flange 124 that are sized to receive grapple portions 143.

Membranes 150 extend between adjacent arches 110, as shown in FIG. 1, to form the interior space of the structure 100. Membranes 150 are elongate strips of a flexible, impermeable material, such as PVC-coated polyester scrim. The membranes 150 have beaded parallel longitudinal edges, adapted to be inserted into and held in place in the rope chases 126. In the illustrated embodiment, the membranes 150 have ropes 152 integral with the beaded longitudinal edge of the membrane 150. For reasons that will be explained below, ropes 152 extend outwardly from one end of the membrane 150 by approximately the same length of the membrane 150. Thus, the combination of the beaded edge of membrane 150 and rope 152 is approximately twice as long as the membrane 150.

Membranes 150 are attached to arches 110 by inserting the longitudinal beaded edge of the membrane 150 into the rope chases 126 of the first flange 122 on either side of the membrane 150. Membranes 150 extend between the adjacent arches 110, and are held in place by the rope chases 126. Although FIG. 4 shows only a single membrane 150 extending from each side of the arch 110, it will be appreciated that a second membrane 150 can be attached to arch 110 by inserting the beaded edge into the rope chases 126 provided on the second flange 124, as well as the first flange 122. This creates a double-membrane wall having an insulating layer between the two membranes 150. Insulation material can be provided in the space between the two membranes 150, if desired.

The Door System

Figure 6:
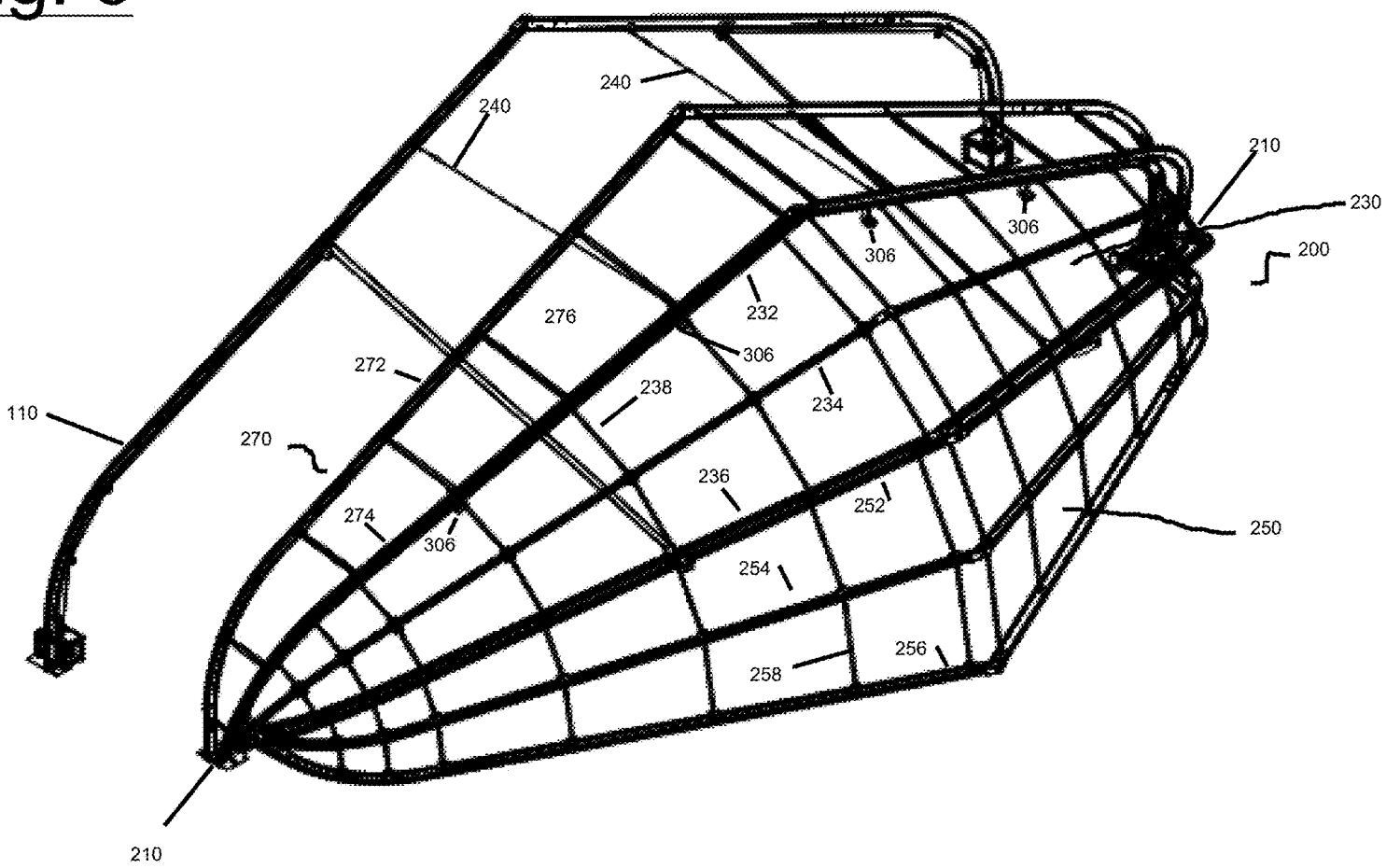
FIG. 6 is a perspective view of the door system shown in FIG. 1.
Figure 7:
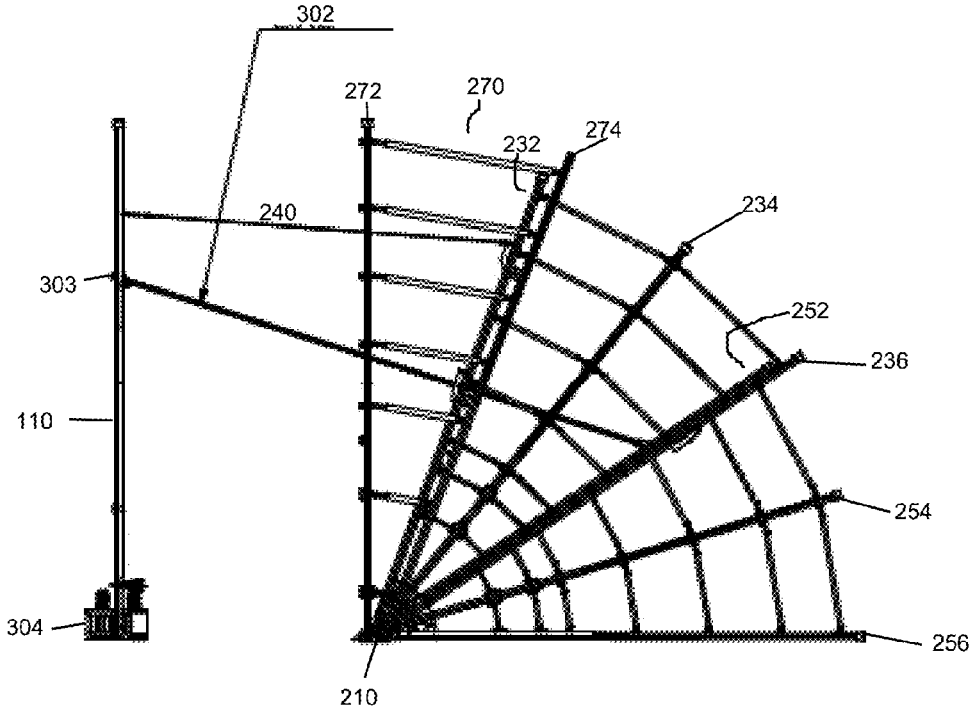
FIG. 7 is a side view of the door system shown in FIG. 1.
Figure 8:
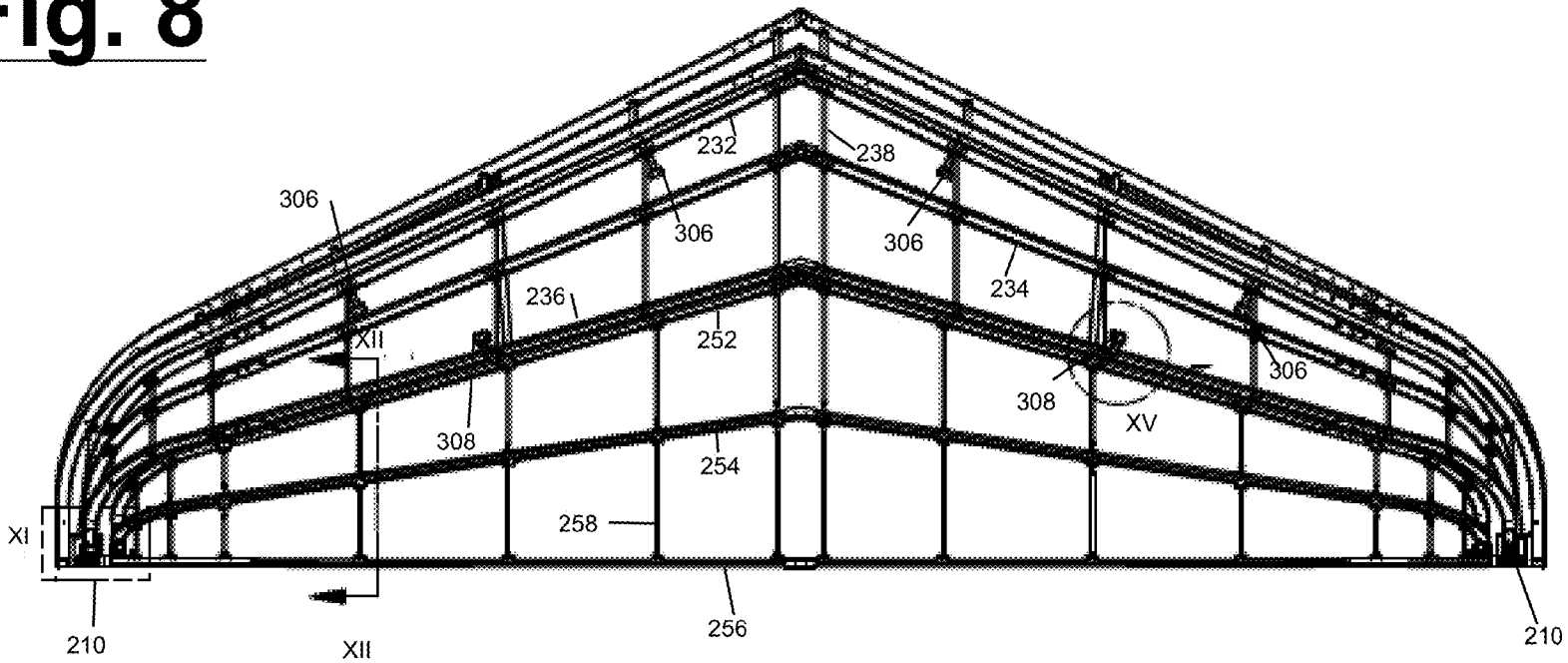
FIG. 8 is an end view of the door system shown in FIG. 1.

The door system 200 is shown in greater detail in FIGS. 6, 7, and 8. The system 200 comprises a pair of door footings 210, one at each side of the opening 160. The system further comprises a first door module 230 and a second door module 250, each extending from one door footing 210 to the other door footing 210. The first and second door modules 230 and 250 extend between the door footings 210 such that the first door module 230 covers an upper portion of the opening 160, and the second door module 250 covers a lower portion of the opening 160. Together, the first and second door modules 230 and 250 cover substantially all of the opening 160. The first and second door modules 230 and 250 are hingedly attached to the door footings 210, such that they can be selectively rotated upwardly, uncovering the opening 160.

The system 200 also comprises a canopy 270, extending from one of a pair of canopy footings 271, adjacent to the door footings 210, to the other of the pair of canopy footings 271. The canopy 270 is fixedly attached to the canopy footings 271, and does not rotate. The canopy is attached to the structure 100, via a membrane (not shown) extending from the canopy 270 to an arch 110 of the structure 100. As will be described in greater detail below, the first and second door modules 230 and 250 rotate to a position beneath the canopy 270 when the door system 200 is opened. However, it will be understood that the canopy 270 is not an essential component of the door system 200, and can be omitted.

Figure 9:
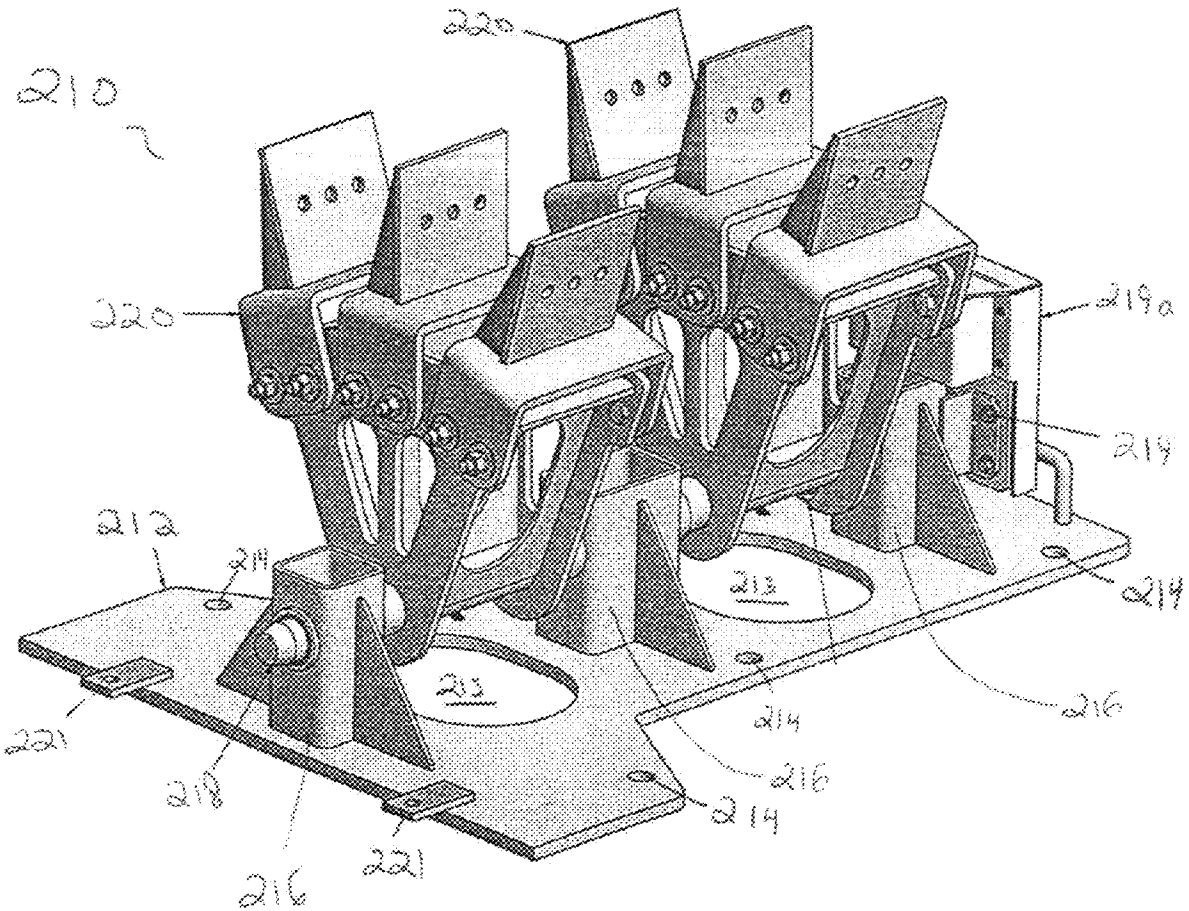
FIG. 9 is a perspective view of a door footing of the door system shown in FIG. 6.

The door footing 210 is shown in detail in FIG. 9. Door footing 210 comprises a base plate 212 having bolt holes 214 formed therein, to allow the base plate 212 to be secured to the ground or other level surface using anchor bolts. The base plate 212 can be made of steel or any other suitable material. In the illustrated embodiment, the base plate 212 comprises a rectangular main portion and a flared end portion, and has openings 213 formed in the interior to reduce weight and material costs. It will be understood, however, that other dimensions are possible, and that openings 213 can be omitted, if desired.

Figure 9A:
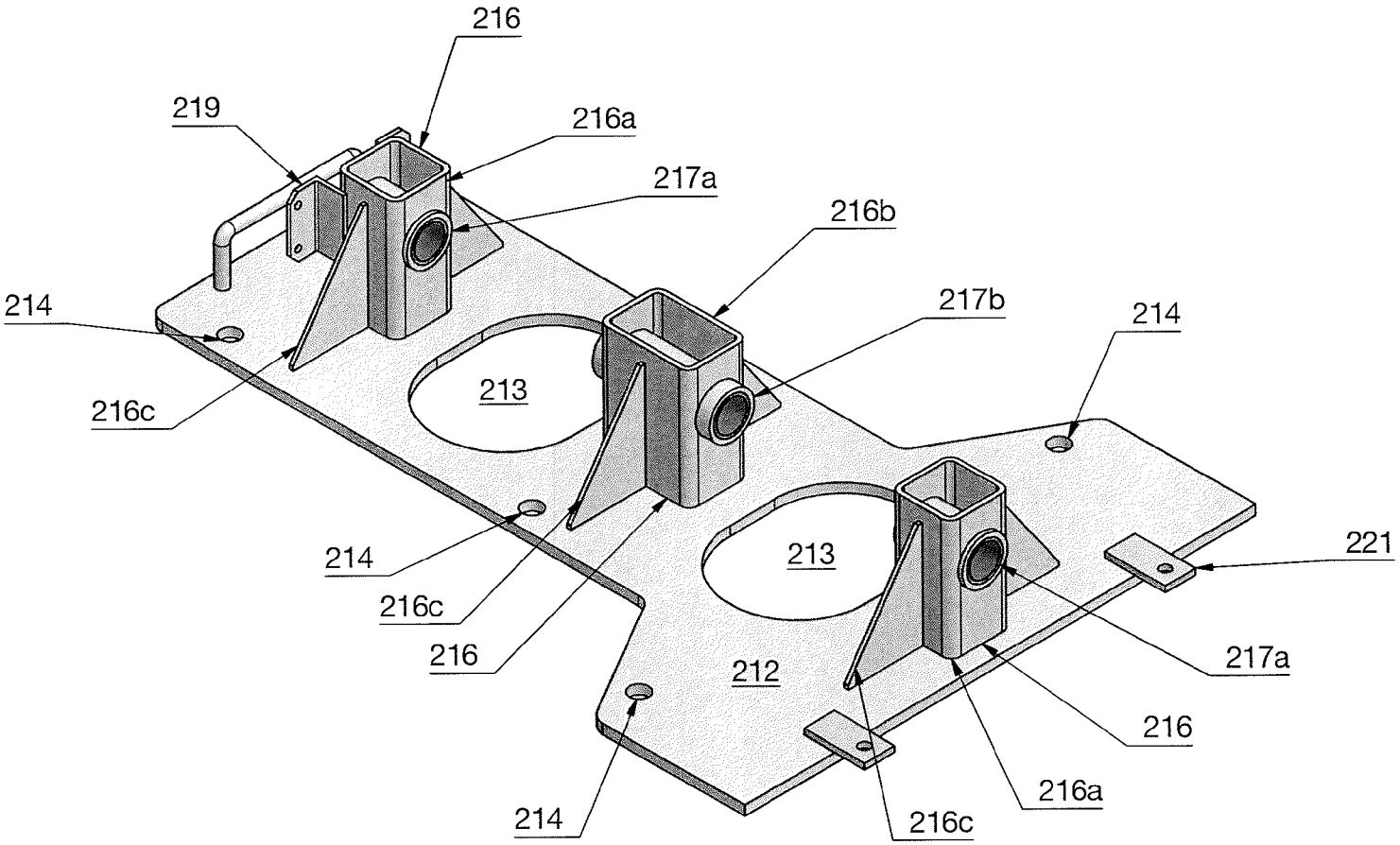
FIG. 9A is a perspective view of a door footing base plate of the door system shown in FIG. 6.

Additional features of the base plate 212 are shown in greater detail in FIG. 9A. Base plate 212 has a plurality of axle mounts 216 for supporting an axle 218. Axle mounts 216 each comprise a rectangular tube (216*a* in respect of the mounts 216 adjacent to either end of the base plate 212, and 216*b* in respect of the central mount 216) welded to base plate 212, supported by triangular flanges 216*c* welded to the base plate 212 and tubes 216*a*, 216*b*. In the illustrated embodiment, the tubes 216*a*, 216*b* and the flanges 216*c* are steel. Tube 216*a* is 4"×4"×7⅞", and tube 216*b* is 6"×4"×7⅞". Triangles 216*c* are each 7" tall and 5" wide.

Tubes 216*a* and 216*b* include pipes 217*a* and 217*b* extending through openings formed in tubes 216*a* and 216*b*. Bronze bushings (not shown) are provided in pipes 217*a* and 217*b* for receiving axle 218 and allowing axle 218 to rotate about its longitudinal axis within the bushings. Pipe 217*a* is a steel pipe 3½" in diameter and 4½" long. Pipe 217*b* is steel, 3½" in diameter and 7¾" long.

Axle 218 is a steel rod 2" in diameter and 44" long. Axle 218 has a tapered end to facilitate insertion of axle 218 into the bronze bushings of the axle mounts 216. Axle 218 is supported by, and rotatable within axle mounts 216, as shown in FIG. 9.

Figure 9B:
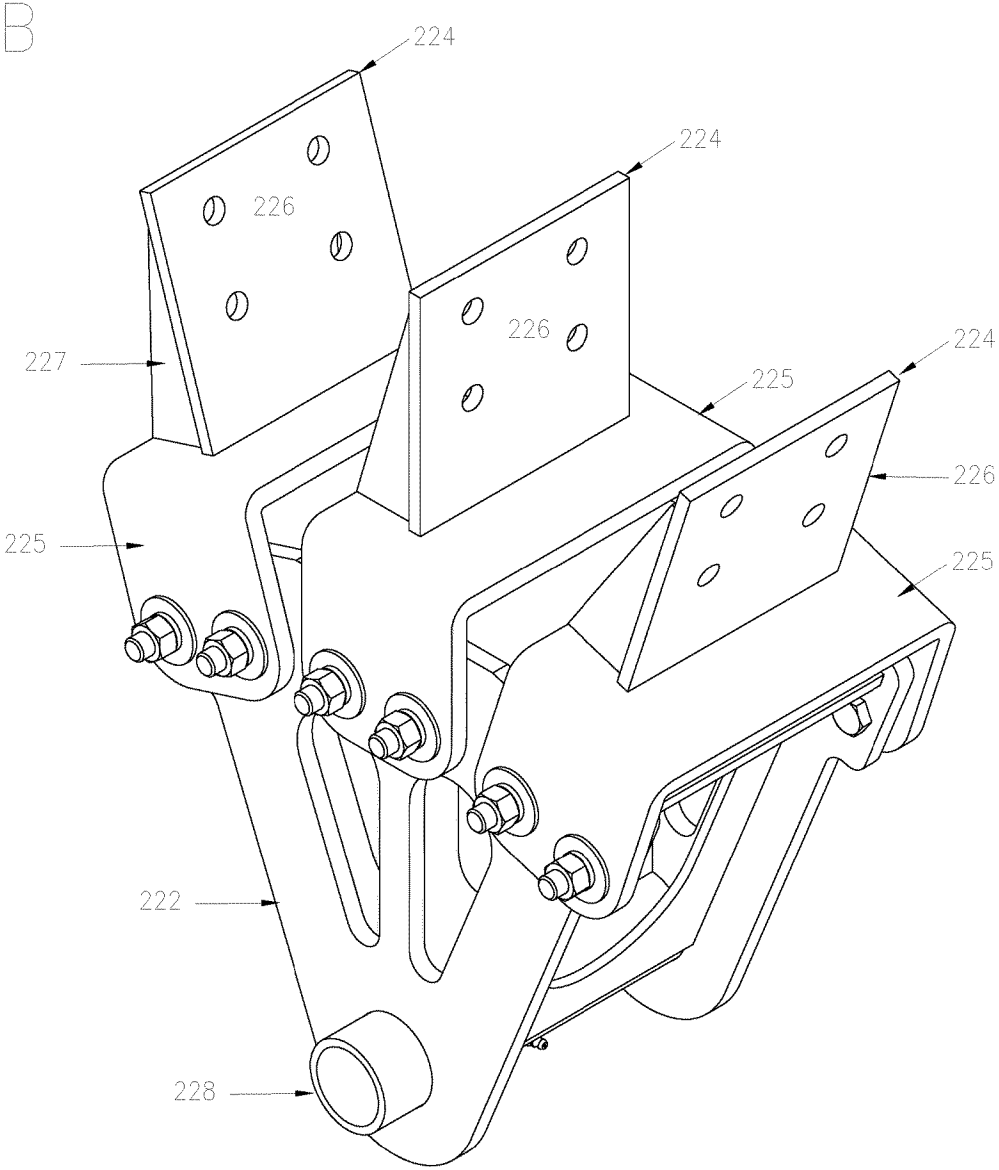
FIG. 9B is a perspective view of a door mounting bracket of the door system shown in FIG. 6.
Figure 9C:
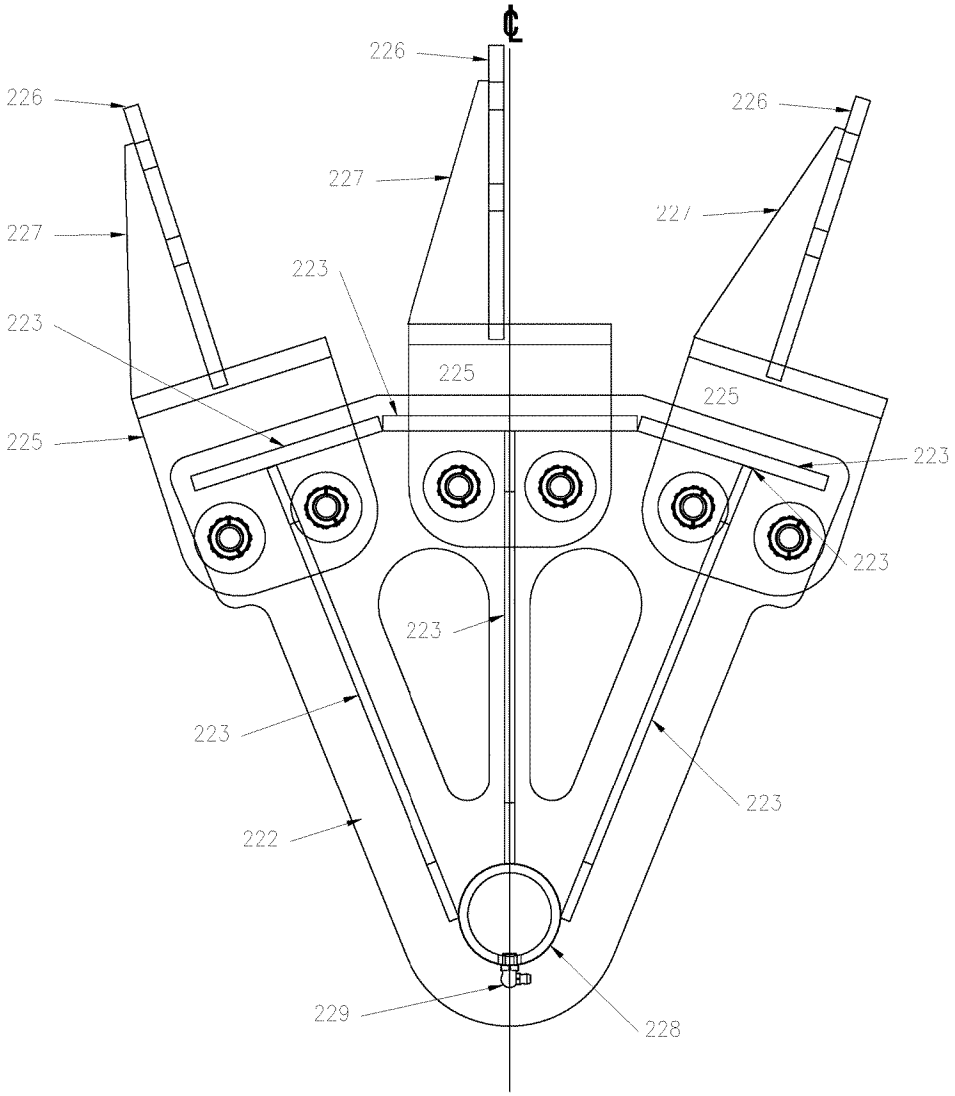
FIG. 9C is a side view of the door mounting bracket shown in FIG. 9B.

Door footing 210 further comprises a pair of mounting brackets 220 for hingedly mounting the door modules 230, 250 to the footing 210. Mounting bracket 220 is shown in greater detail in FIGS. 9B and 9C. Mounting bracket 220 comprises a generally triangular assembly 222 having three facets along one side. Assembly 222 comprises two spaced-apart steel triangular plates having the faceted triangular shape of the assembly 222, joined by a series of steel rectangular plates 223 extending between the triangular plates and joined to the triangular plates by welding.

Mounting bracket 220 also includes attachment brackets 224 mounted to each facet of assembly 222, for attaching door modules 230, 250 to the mounting bracket 220. Attachment brackets 224 include a steel C-shaped bracket 225 attached to each facet of assembly 222 via any suitable means (in this case, with threaded nuts and bolts). A steel flange 226 is welded to the C-shaped bracket 225 and extends perpendicularly to the facet of assembly 222. Bolt holes are formed in the steel flange 226 to facilitate the attachment of door module 230 or 250 to the flange, in the manner described below. Triangular flanges 227 are welded to both the flange 226 and the C-shaped bracket 225 to support the flange 226.

Mounting bracket 220 further includes pipe 228 extending through openings formed in assembly 222 opposite the faceted side. Pipe 228 receives axle 218 when the door footing 210 is assembled as described below. Grease fitting 229 is provided adjacent to pipe 228 to allow for lubrication.

A fully assembled door footing 210 is shown in FIG. 9. The footing 210 is assembled by providing two mounting brackets 220, one on either side of the central tube 216*b*, and aligning pipe 228 of each mounting bracket 220 with pipes 217*a* and 217*b*. Axle 218 is then inserted through pipes 217*a*, 217*b* and 228. Grease is added as required through grease fitting 229. Finally, an encoder pack 219*a* (described in greater detail below) is mounted to the door footing 210 via flanges 219 welded to tube 216*a* adjacent to one end of the footing 210.

Figure 10:
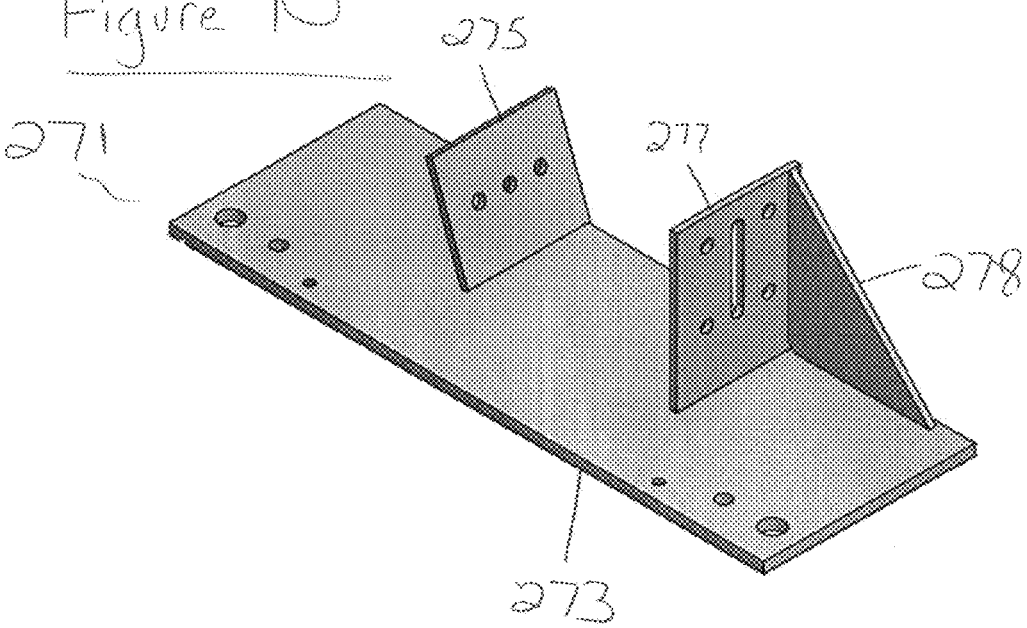
FIG. 10 is a perspective view of a canopy footing of the door system shown in FIG. 6.

Canopy footing 271 is shown in detail in FIG. 10. Canopy footing 271 comprises canopy base plate 273, a steel plate 34" long and 12" wide. Canopy base plate 273 has holes formed therein to allow the canopy base plate 273 to be secured to the ground or other level surface using anchor bolts. The canopy base plate 273 also has holes to facilitate attachment to base plate 212 using attachment flanges 221 (shown in FIG. 9). Anchor bolts are inserted through the bolt holes in both the attachment flanges 221 and the canopy base plate 273 to attach the canopy base plate 273 to the base plate 212.

Canopy footing 271 further comprises canopy flanges 275 and 277 extending from canopy base plate 273. Flange 275 is a 7"×6" steel plate that is welded to canopy base plate 273 and extends from canopy base plate 273 at an angle of 70°. Flange 277 is a 9"×8" steel plate welded to canopy base plate 273 and extending perpendicularly therefrom. Flanges 275 and 277 each have bolt holes for facilitating the attachment of other components of the canopy 270, as described in greater detail below.

Canopy footing 271 further comprises triangular support plate 278, welded to the base plate 273 as well as flange 277, to provide structural support for flange 277. A similar triangular support plate (not shown) is provided to support flange 275.

The first and second door modules 230 and 250 are shown in FIGS. 6, 7, and 8. The first door module 230 comprises arches 232, 234 and 236 that are constructed of curved and substantially straight lengths of I-beam that are identical to that from which arches 110 are constructed. In fact, arches 232, 234 and 236 are essentially identical to arches 110, with the exception of dimensions. Arches 232, 234 and 236 have a width W and height H that are smaller than those of arches 110, which enables the door module 230, made therefrom, to fit inside the interior area of the structure 100 when the door system 200 is opened. In the illustrated embodiment, arches 232, 234 and 236 have a width W of 86' 8" and a height H of 31' 8". It will be understood, however, that different dimensions can be used, so long as the dimensions are smaller than those of arches 110.

Figure 11:
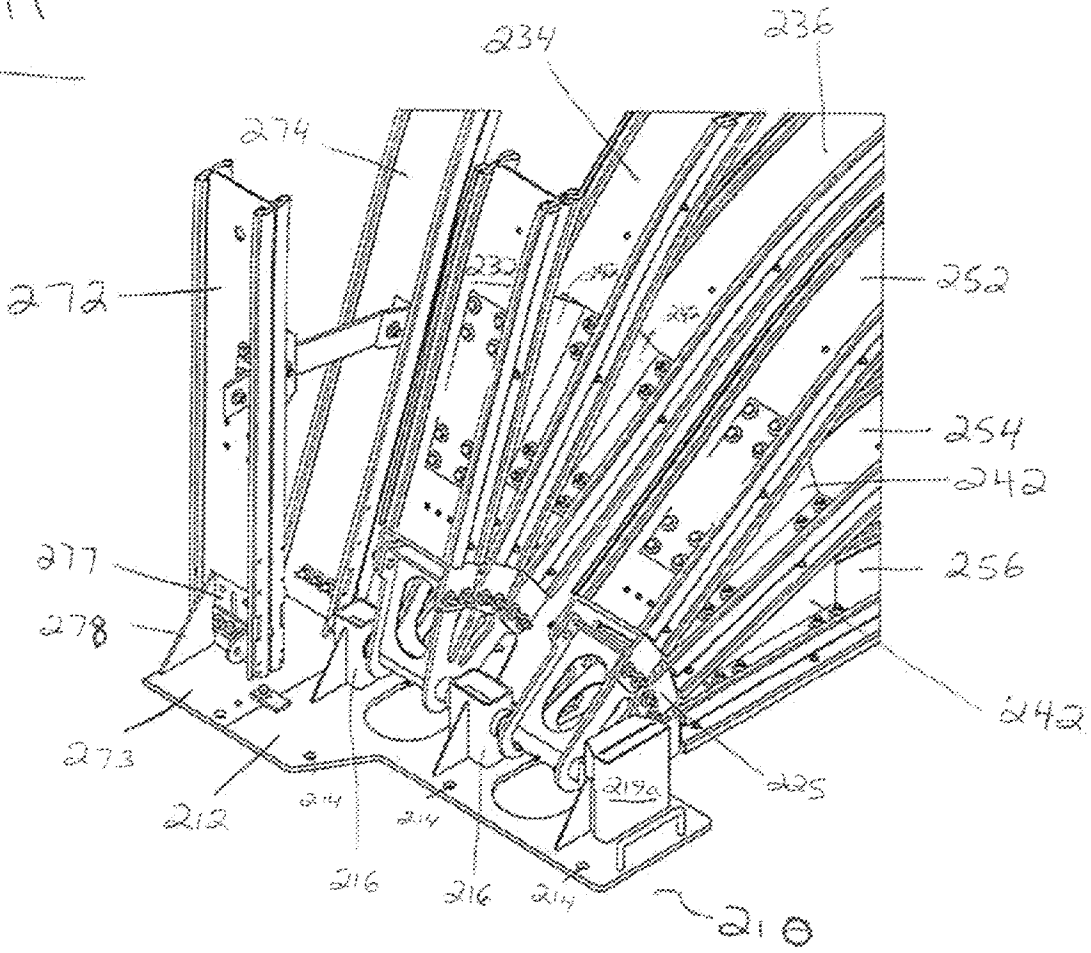
FIG. 11 is a perspective view of the area of FIG. 8 marked XI.
Figure 12:
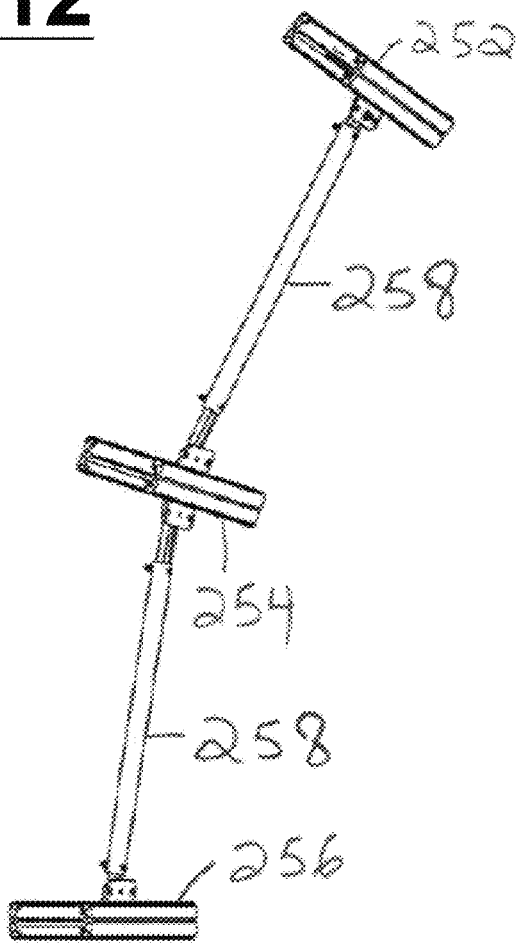
FIG. 12 is a cross-section view taken along the line XII-XII in FIG. 8.

Door module 230 is formed by mounting the ends of arches 232, 234 and 236 to door footings 210 positioned at either side of the opening 160 to the structure 110, as shown in FIG. 11. One end of each arch 232, 234 and 236 is attached to one of the flanges 226 of the mounting brackets 220 by aligning bolt holes in arches 232, 234 and 236 with the bolt holes formed in flanges 226, and securely bolting arches 232, 234 and 236 to flanges 226.

Stiffening braces 242 are provided between arches 232 and 234, and between arches 234 and 236, to strengthen the connection of the arches 232, 234 and 236 to the door footing 210, and to help ensure that the arches 232, 234 and 236 extend from axle 218 at an angle of 17.75° relative to each other. Stiffening braces 242 each comprise a pair of metal plates bolted to arches 232, 234 or 236, with a third metal plate extending therebetween to provide structural strength. The third metal plate is dimensioned such that the arches to which brace 242 is bolted are held apart at an angle of 17.75°.

The result of mounting arches 232, 234 and 236 to door footings 210 as described above is a roughly diamond-shaped protruding frame extending outwardly from the door footing 210 at one side of the opening 160, to the door footings 210 at the opposite side of the opening 160. The shape of the frame formed by arches 232, 234 and 236 is maintained by a plurality of spreaders 238. In the illustrated embodiment, spreaders 238 are substantially identical to spreaders 138, and are attached to arches 232, 234 and 236 in substantially the same way as spreaders 138 are attached to arches 110; however, it will be understood that essentially any telescopic rod, and any suitable means of attachment, can be used.

Membranes (not shown) are stretched between arches 232 and 234, and arches 234 and 236 to form panels that serve as upper and lower portions of the door 200. The membranes provided between arches 232, 234 and 236 can be essentially identical to membranes 150, with the exception of the shape (the membranes for the door module 230 must be roughly diamond shaped, to correspond with the space between adjacent arches 232, 234 and 236). The membranes can be held in place in the same manner that membranes 150 are held in place (i.e., by way of a beaded longitudinal edge retained in C-shaped rope chases formed by the I-beams that form arches 232, 234 and 236).

The second door module 250 is essentially identical to first door module 230, with the exception of the arms 306 and stopping flanges 308 (discussed in greater detail below) and the dimensions of the arches 252, 254 and 256 used to create the second door module. In particular, the width W and height H of arches 252, 254 and 256 are smaller than those of arches 232, 234 and 236. In the illustrated embodiment, the width W of arches 252, 254 and 256 is 83' 4" and the height H is 29' 9". It will be understood, however, that different dimensions can be used, so long as the dimensions are smaller than those of the arches 232, 234 and 236.

Figure 13:
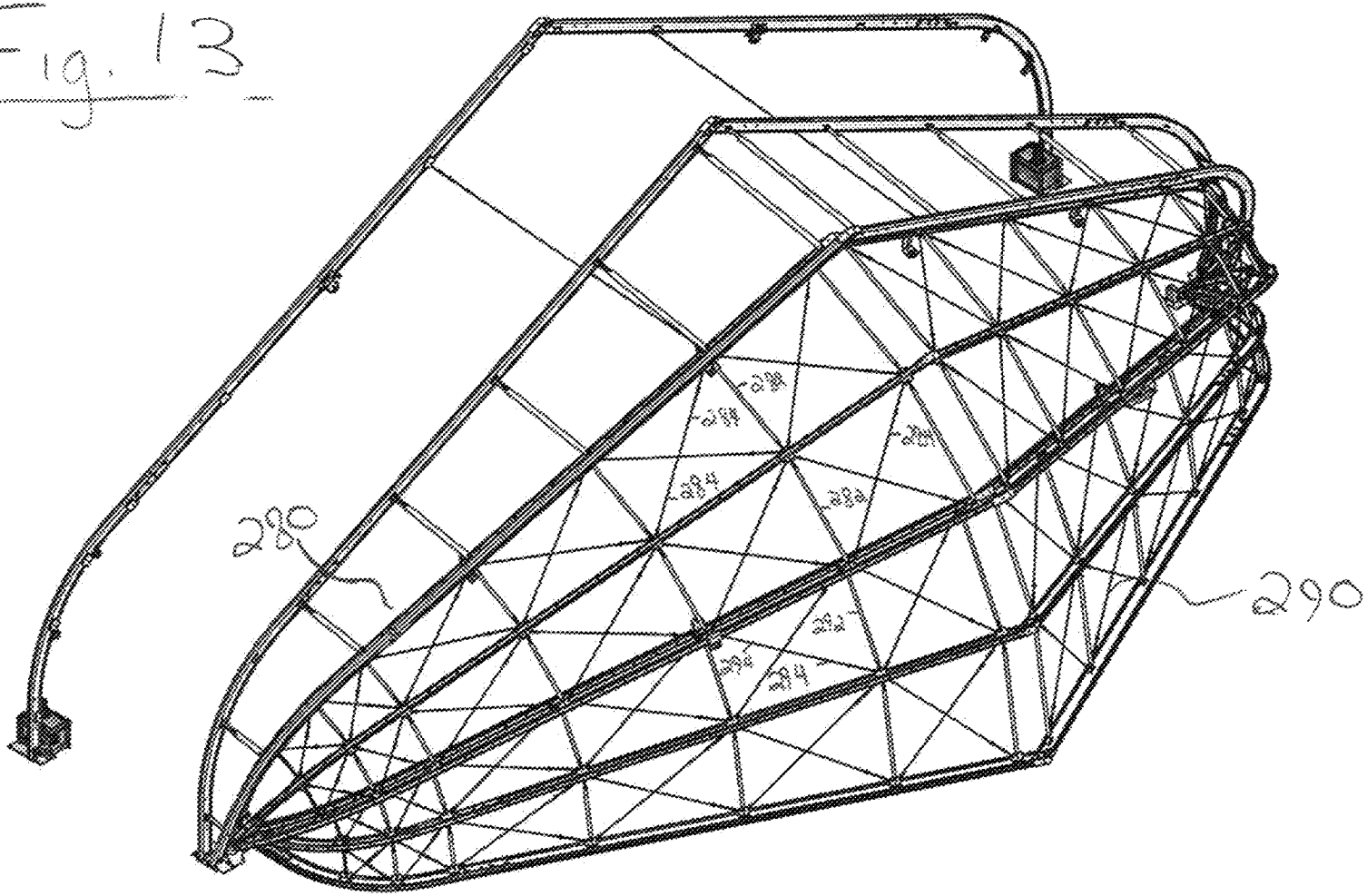
FIG. 13 is a perspective view of an alternative embodiment of the door system of the present invention.

An alternative embodiment of the first and second door modules 280 and 290 is shown in FIG. 13. Door modules 280 and 290 are essentially identical to door modules 230 and 250, except that door modules 280 and 290 also comprise a plurality of cables 284, 294, in addition to spreaders 282, 292. Cables 284, 294 extend diagonally between the connection points between the arches 232, 234, 236, 252, 254 or 256, and the spreaders 282, 292. Cables 284, 294 provide additional structural support for the door modules 280, 290 by acting as bracing between the spreaders 282, 292. Cables 284, 294 can be essentially any cable strong enough to providing bracing between the spreaders 282, 292. By way of example, cables 284, 294 can be steel cables ½" in diameter.

When the door 200 is closed, the second door module 250 covers the lower portion of the opening 160. Arch 256 rests on the ground or other surface on which structure 100 is deployed, and door module 250 extends upwardly over approximately half of the opening 160.

First door module 230 is held in position covering the upper half of opening 160 by a pair of cables 240. Cables 240 are attached at one end to arch 232, at either side of the peak of the arch. Cables 240 are attached at the other end to one of the arches 110 of the structure 100. The length of cables 240 is selected such that, when the cables 240 are taught the first door module 230 is positioned over the upper half of the opening 160. Cables 240 can be essentially any type of cable capable of supporting the first door module 230 over the upper half of the opening 160. In the illustrated embodiment, cables 240 are each ½" steel cables.

The canopy 270 comprises an upright arch 272 extending substantially perpendicularly from canopy footing 271 at one side of the building, to another canopy footing 271 at the other side of the building. Canopy 270 also comprises an inclined arch 274, extending from one canopy footing 271 to the other canopy footing 271. Inclined arch 274 is at an angle of 20° with respect to upright arch 272, although it will be understood that other angles are possible.

Both upright arch 272 and inclined arch 274 are made of the same curved and substantially straight I-beams as arches 110, and are of substantially the same dimensions. Upright arch 272 and inclined arch 274 are secured to attachment flanges 277 and 275, respectively, in the same manner that arches 110 are secured to attachment flanges 134 of the foot portions 112, 116.

A plurality of spreaders 276 extend between the upright arch 272 and inclined arch 274, providing structural support to the canopy 270. Spreaders 276 may be identical to spreaders 138 and 238, and may be attached to the upright arch 272 and inclined arch 274 in the same manner as spreaders 138 and 238 are attached to arches 110 and 232, 234 and 236, respectively. However, it will be understood that essentially any telescopic rod can be used for spreader 276, and can be secured to the upright arch 272 and inclined arch 274 in any suitable manner.

A membrane (not shown) extends between the upright arch 272 and the inclined arch 274. The membrane may be identical to the membrane 150, with the exception of its shape. It will be understood that, in order to extend across the space between upright arch 272 and inclined arch 274, the membrane must be roughly diamond-shaped. The membrane can be secured to the upright arch 272 and inclined arch 274 in substantially the same manner that membrane 150 is secured to arches 110 (i.e., with beaded longitudinal edges inserted in and retained by C-shaped rope chases provided along the edges of the upright arch 272 and the inclined arch 274).

Erecting a Structure Having the Door System

The structure 100 having the door system 200 can be erected as described herein. First, the arches 110 are stood up and spaced apart, each of the foot portions 112, 116 of the arches 110 are attached to the I-beams comprising the arches 110. The foot portions 112, 116 are freely shiftable along the surface beneath structure 110, by use of rollers (not shown) temporarily positioned under the foot portions 112, 116, or any other suitable means.

The spreaders 138 are attached to the arches 110 so that there are spreaders 138 extending between each pair of adjacent arches 110. Next, as described subsequently, the membranes 150 are attached to the arches 110. Once this is done, the membranes 150 are down stretched with winches, and to keep them in place before the next step, bolts are put through the beaded edges of membranes 150. Next, each of the arches 110 are spread apart by extending the length of the spreaders 138, so that spacing of the arches 110 is increased and membranes 150 are tautened. After that, temporary rollers are removed from under the foot portions 112 and 116, and the foot portions 112, 116 are secured to the surface beneath structure 110, for example, a concrete slab, to positionally fix the arches 110. Arches 110 are fixed to the concrete slab (or other surface) using anchor bolts inserted through bolt holes 132 in base plate 130, and into the concrete slab, as described above.

The membranes 150 are connected to the arches 110 as described herein. First, the rope chases 126 of the I-beams from which arches 110 are made are lubricated, in order to reduce friction for advancement of the beaded edge of membrane 150 through the rope chase 126. Preferably, a dry silicone lubricant can be used, and this lubricant is sold in spray canisters. Such lubricant may be conveniently sprayed into the rope chases 126.

In one embodiment, known rope advancing machines, electric or hand-operated, are installed at the ends of a pair of arches 110 opposite the end into which the membrane 150 will be fed. Rope 152 extending from each side of membrane 150 is positioned in the rope chases 126 along the length of the arches 110. This can be done in an automated manner.

Membranes 150 are advanced from one end of arches 110 to the other by advancing the rope 152 using known rope advancing machines. As the membrane 150 advances into the rope chases 126 of the arches 110, two workers stand at the base of the arches 110 where the membrane 150 enters into the rope chases 126. The workers stand at opposite edges of the membrane 150 to ensure that the membrane properly advances into the rope chases 126.

A worker is also located at each of the two rope advancing machines (one rope advancing machine per arch 110 of the pair of arches 110). These workers can control the operation of the rope advancing machines. For example, they can slow down the advancement of the membrane 150 if instructed to do so by one of the workers at the opposite base of the pair of arches 100.

In one embodiment, two additional workers can be deployed at the apex of the structure 110, to monitor the progress of the membrane 150 through the rope chases 126 from that position. One worker can be located at the peak of each arch 110 of the pair of arches 110, and can advise as to whether advancement of the membrane 150 should slow down (or speed up) depending on the progress of the membrane 150 through the rope chases 126.

The rope advancing machines are employed again when the building structure is demounted. In particular, the rope advancing machines advance the membrane 150 half way out. At this point, the remaining portion of the membrane 150 can be simply pulled out manually.

The foregoing steps can be used to erect the main body of the structure 110, having an open end 160 at which the door 200 can be deployed. Once the main body is erected, upright arch 272 can be stood up and attached to canopy footings 271 by inserting bolts through bolt holes in attachment flange 277 and corresponding bolt holes formed in upright arch 272. Canopy footings 271 and upright arch 272 are then placed adjacent to the last arch 110 in the row of arches 110 of the structure 100. Canopy footings 271 are freely shiftable along the surface beneath the structure 110, by use of rollers (not shown) temporarily positioned under the canopy footings 271, or any other suitable means.

Spreaders 128 are then attached to arch 110 at one end, and the upright arch 272 of the canopy 270 at the other end. A membrane 150 is then attached to the arch 110 and upright arch 272 in the same manner that other membranes 150 are installed. Membrane 150 is then stretched down with winches, and bolts are put through beaded edges of membrane 150 to hold membrane 150 in place. Upright arch 272 and canopy footings 271 are then moved away from arch 110 by extending the length of spreaders 138, so that the membrane 150 becomes taught. Then, temporary rollers are removed from under the canopy footings 271 and the footings 271 are secured to the surface beneath the structure 100 using anchor bolts extending through bolt holes 214.

Next, inclined arch 274 is erected adjacent to upright arch 272, and a membrane similar to membrane 150 but roughly diamond shaped is installed between upright arch 272 and inclined arch 274 in substantially the same manner that membranes 150 are installed. Upright arch 272 and inclined arch 274 must be very close together to allow the narrowest portion of the diamond shaped membrane to be pulled completely over the arches 272 and 274 during installation. To allow this to occur, the diamond shaped membrane is installed before spreaders 276 are attached to the arches 272 and 274, and before the inclined arch 274 is bolted to the canopy footings 271.

Once the diamond shaped membrane is installed between arches 272 and 274, the inclined arch 274 is fastened to canopy footings 271 by inserting bolts through bolt holes in attachment flange 275 and corresponding bolt holes formed in inclined arch 274. Spreaders 276 are then installed extending between upright arch 272 and inclined arch 274. Spreaders 276 are extended to tension the diamond shaped membrane.

Next, the first door module 230 is assembled and installed as follows. First, door footings 210 are placed adjacent to canopy footings 271 and attached to canopy footings 271 as described above. Next, arches 232, 234 and 236 are attached to mounting brackets 220 as described above. One of the two bolts attaching C-shaped brackets 225 to assembly 222 is removed, allowing C-shaped brackets 225, flanges 226 and arches 232, 234 and 236 to pivot about the remaining bolt attaching C-shaped brackets 225 to assembly 222. Arches 232 and 234 are then pivoted to within close proximity of each other, allowing a diamond shaped membrane to be installed between arches 232 and 234 in the same manner that a diamond shaped membrane is installed between arches 272 and 274 (described above). Similarly, a diamond shaped membrane is installed between arches 234 and 236.

Once diamond shaped membranes are installed, arches 232, 234 and 236 are pivoted away from each other, and spreaders 238 are installed and extended between arches 232, 234 and 236, tensioning the membranes. The removed bolts attaching C-shaped brackets 225 to assembly 222 are re-attached, and stiffening braces 242 are attached to arches 232, 234 and 236. Finally, newly assembled first door module 230 is rotated about axle 218 to a position such that it is covering the upper half of opening 160. At this point, cables 240 are attached to arch 232 and to arch 110, holding the first door module 230 in place covering the upper portion of opening 160.

Second door module 250 is then assembled in substantially the same manner as first door module 230. Second door module 250 is attached to door footing 210 adjacent the first door module 230, but not the upright arch 272 and inclined arch 274. As well, second door module 250 is not attached to arch 110 via a cable. Rather, second door module 250 is allowed to rest on the ground (or other surface on which the structure is erected), covering the lower half of opening 160.

Operating the Door System

Figure 14:
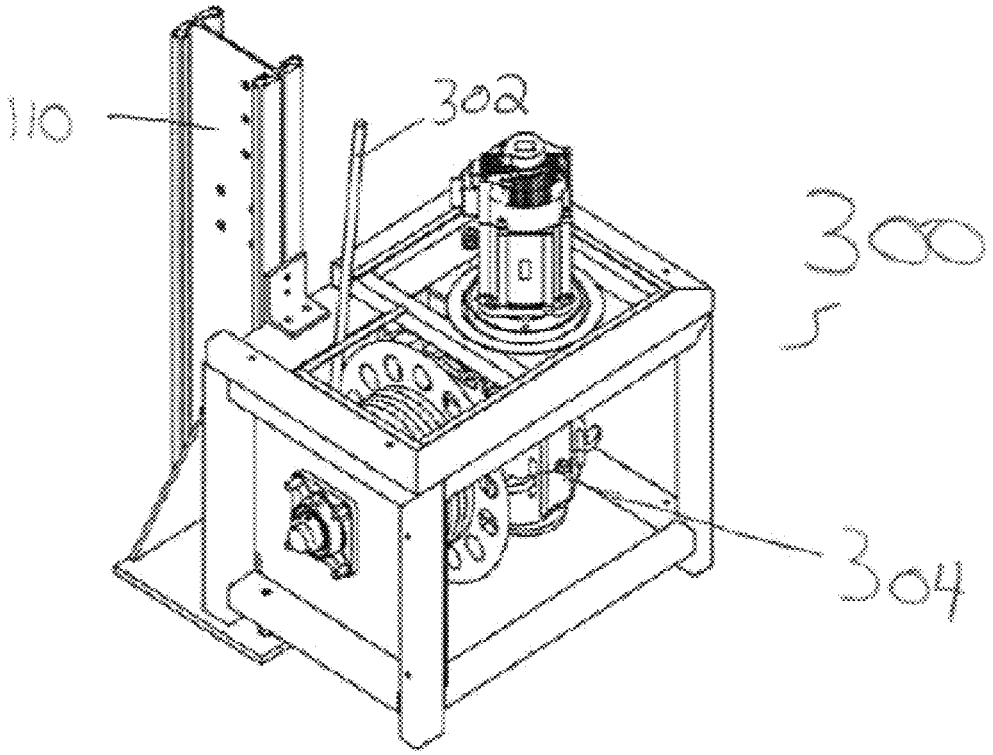
FIG. 14 is a perspective view of a winch and cable system for use with the door system of FIG. 8.

Starting from the closed position, the door system 200 can be opened in the following manner. First, the second door module 250 is rotated about axles 218 towards an open position. In the illustrated embodiment, this is accomplished using a door opening system 300 (shown in FIGS. 7 and 14) comprising a pair of lifting cables 302 and a pair of motorized winches 304. The lifting cables 302 are each attached at one end to arch 252, on either side of the apex of arch 252. The lifting cables 302 extend from arch 252 to a pair of pulleys 303 attached to the arch 110 that is adjacent to canopy 270. From pulleys 303, the lifting cables 302 extend downwardly to motorized winches 304 located at the first and second foot portions 112 and 116 of arch 110, respectively.

As will be explained below, the lifting cables 302 and motorized winches 304 will be used to lift both the second door module 250 to which it is attached, and the first door module 230, and rotate said modules about the axles 218. It will therefore be understood that any cable, pulley and motorized winch suitable for lifting the weight of both the first and second door modules 230, 250 and rotating said modules about axles 218 can be used. In the example embodiment, motorized winches 304 are each driven by a 10 horsepower electric motor coupled to a gearbox having a 60:1 gear ratio, which produces a relatively low amount of noise during operation. In areas where access to an electrical power grid is not available, the motorized winches 304 can be powered by a 7.5 kW electrical generator, which is known in the art. The lifting cables 302 are ¾" in diameter, and each has an average strength of 64,000 pounds.

As the second door module 250 is rotated toward an open position, the leading edge of module 250 catches first door module 230 such that, continued rotation of second door module 250 causes first door module 230 to rotate as well. This is accomplished by providing a set of four arms 306 (shown in FIGS. 6 and 8) that extend downwardly from arch 232 of the first door module. As second door module 250 rotates toward an open position, arch 252 of second door module makes contact with arms 306. Continued rotation of second door module 250 therefore causes arch 252 to push on arms 206, causing first door module 230 to rotate toward an open position.

Figure 15:
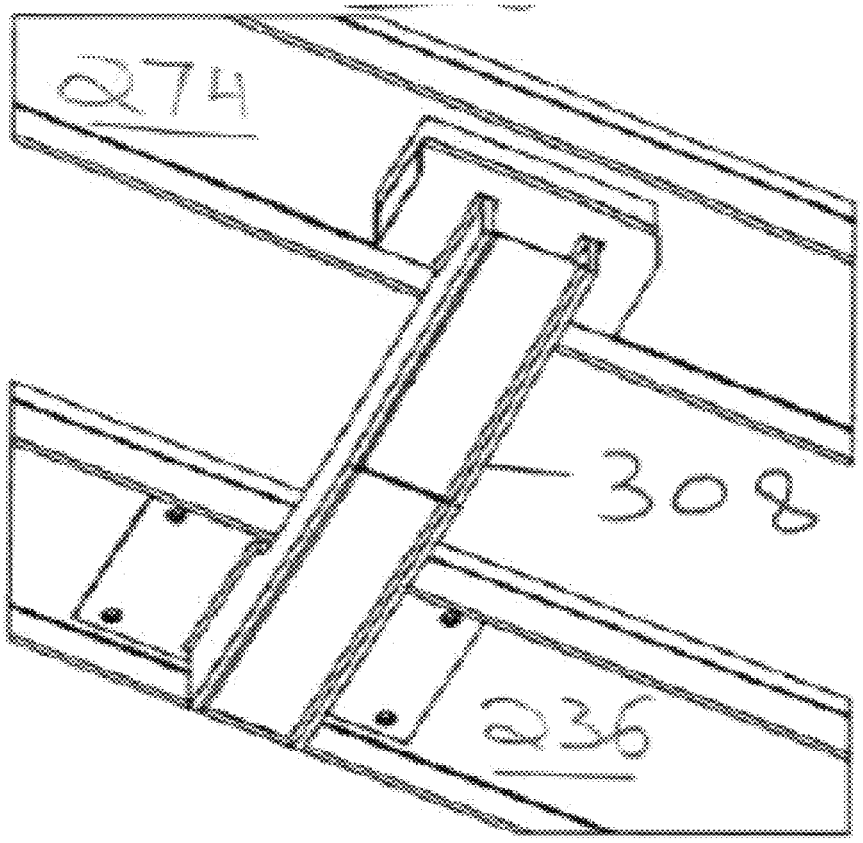
FIG. 15 is a perspective view of a stopping flange for use with the door system of FIG. 8.

It will be understood that arms 306 can be essentially any structure suitable for this purpose. In the illustrated embodiment, arms 306 are of identical construction to stopping flanges 308, which are shown in FIG. 15 and will be described in detail below. It also will be understood that arms 306 can be attached to arch 232 in essentially any suitable manner. In the illustrated embodiment, arms 306 are bolted to arch 232 using bolts extending through bolt holes formed in arms 306 and into corresponding bolt holes formed in the central webs of the I-beams that form arch 232. Arms 306 also could be formed integrally with arch 232. It will further be understood that, while the illustrated embodiment utilizes four arms 306, two placed a distance of 10' 8" from the apex of arch 232, and two placed a distance of 30' 8" from said apex, essentially any number of arms can be utilized, so long as the structural strength of the arm and the connection of the arm to arch 232 is sufficient to support the weight of the first door module 230.

When the second door module 250 and the first door module 230 are rotated to the open position, the inclined arch 274 of the canopy 270 makes contact with a pair of stopping flanges 308 extending from arch 236 of the first door module 230. When contact is made with the inclined arch 274, which is not free to pivot about the axles 218, the rotation of the first and second door modules 230, 250 is stopped. An embodiment of a stopping flange 308 is shown in FIG. 15, and consists of an I-beam extending from a mounting plate at one end, for attaching the stopping flange 308 to arch 236, to a padded plate at the other end for making contact with inclined arch 274. Stopping flange 308 is bolted to arch 236 using bolts extending through bolt holes formed in the mounting plate and through corresponding bolt holes formed in the I-beams that form arch 236. As shown in FIG. 6, two stopping flanges 308 are provided on arch 236, each a distance of 20' 8" from the apex of arch 236. However, it will be understood that any number of stopping flanges can be used, that the stopping flanges can be of any construction that will stop the rotation of first and second door modules 230, 250 when the stopping flanges make contact with the inclined arch 274, and that the stopping flanges can be attached to arch 236 in any suitable manner (or could be formed integrally with arch 236).

As an alternative to the opening method stated above, the door 200 can be moved to a partially open position by taking in lifting cable 302 until the second door module 250 has rotated approximately half way towards the open position. In this position, both the first and second door modules 230 and 250 are covering the upper portion of the opening 160, and the lower portion of the opening 160 is left unobstructed, providing a partially open door position.

To move the door system 200 back to the closed position, motorized winch 304 lets out the lifting cable 302 in a controlled manner, allowing the second door module 250 to rotate back toward the closed position. It is important to let out lifting cable 302 in a controlled, as opposed to uncontrolled manner using the motorized winch 304, so that the door module 250 does not fall uncontrollably down to the closed position, which could cause injury or property damage.

When the second door module 250 has rotated approximately half way towards the closed position, and is covering the upper portion of the opening 160, the second door module 250 connects with the first door module 230, such that continued rotation of the second door module 250 towards the closed position also rotates the first door module 230 towards the closed position. Contact is made by way of a pair of safety catches 310 and 312, shown in FIG. 16. The first door safety catch 310 comprises an approximately S-shaped bracket made of ⅜" steel. The safety catch 310 is mounted to arch 236 of the first door module 230 such that the catch 310 extends inward toward the interior of structure 100 and upward, toward the roof of structure 100. Safety catch 310 is mounted to arch 236 with ⅝" steel bolts 311 extending through bolt holes formed in the safety catch 310 and the second flange 124 of arch 236. Bolts 311 are held in place using nuts and lock washers.

The second door safety catch 312 comprises a ⅜" steel bracket having an F-shaped cross section, extending from a rectangular base. The safety catch 312 is mounted to arch 252 of the second door module 250 such that it extends outward toward the exterior of structure 100, and downward toward the concrete pad on which structure 100 is erected. Safety catch 312 is mounted to arch 252 with ⅝" steel bolts 313 extending through bolt holes formed in the base of the safety catch 312 and the first flange 122 of arch 252. Bolts 313 are held in place using nuts and lock washers.

Figure 16:
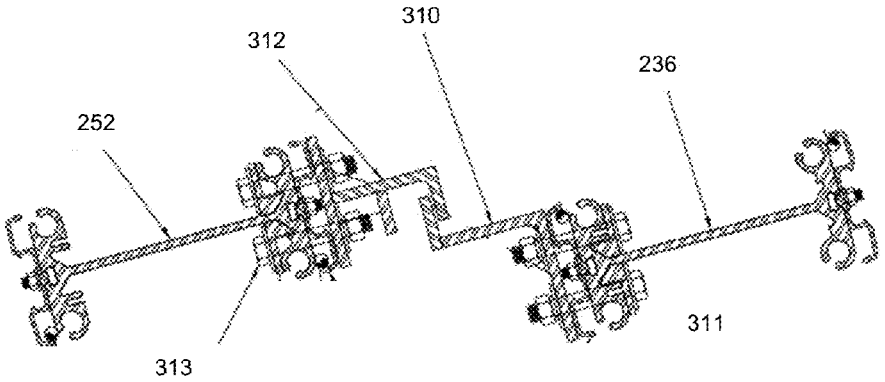
FIG. 16 is a side sectional view of a pair of interlocking safety catches for use with the door system of the present invention.

The first and second door safety catches 310 and 312 are positioned on arches 236 and 252 respectively, and dimensioned such that, when arch 252 moves past arch 236 while the second door module 250 is moving towards the closed position, the first door safety catch 310 is received within second door safety catch 312, as shown in FIG. 16. The interlocking of the safety catches 310 and 312 as shown in FIG. 16 connects the first and second door modules 230 and 250. Thus, continued movement of the second door module 250 towards the closed position causes the first door module 230 to rotate towards the closed position. In the exemplary embodiment shown, first door and second door safety catches 310 and 312 each extend 4⅜" from arches 236 and 252, respectively.

Once the second door module 250 reaches the closed position, covering the lower portion of the opening 160, the cables 240 will become taut and support the first door module 230 in the closed position, covering the upper portion of the opening 160. The opening 160 will then be substantially closed.

Figure 17A:
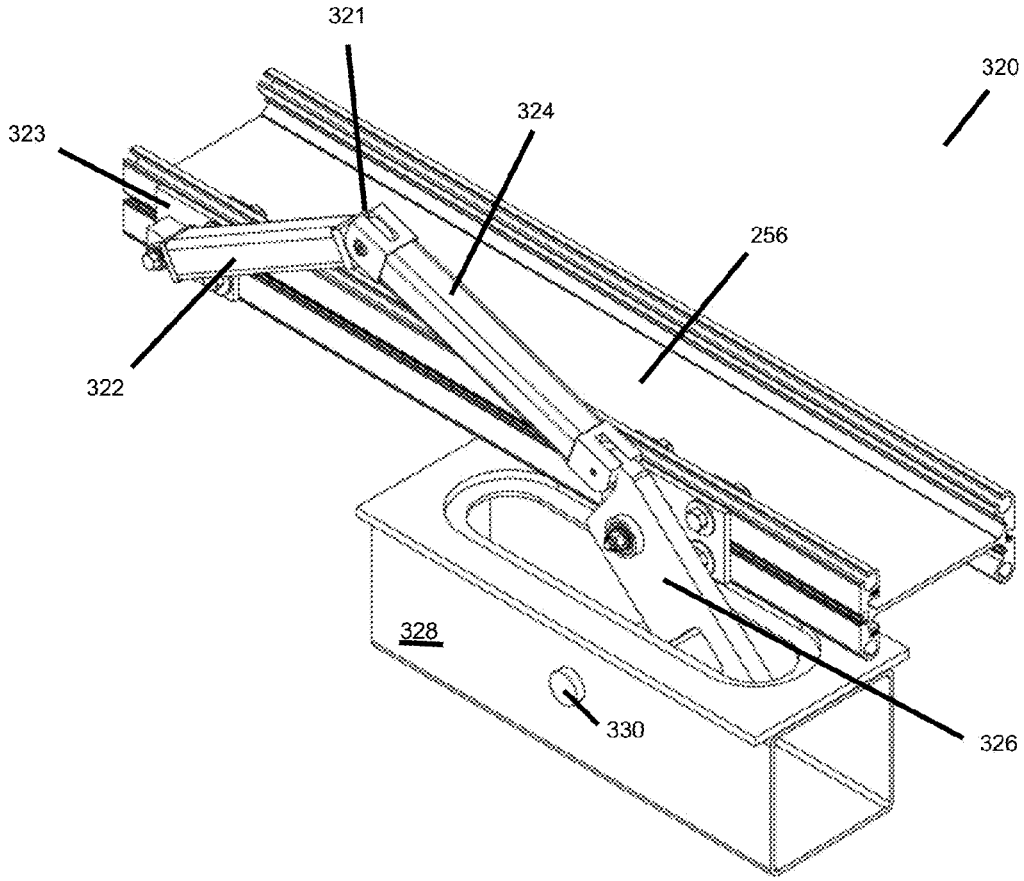
FIG. 17A is a perspective view of a locking mechanism for use with the door system of the present invention.
Figure 17B:
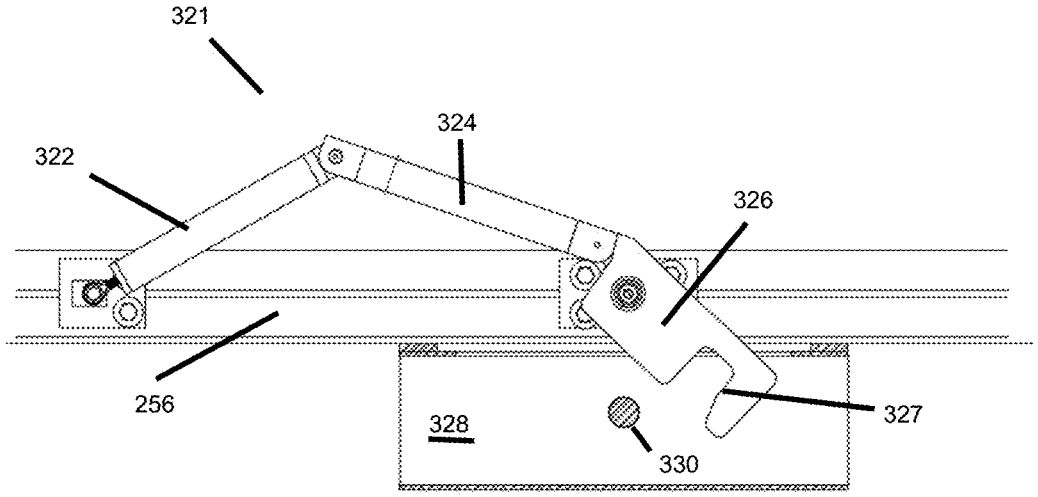
FIG. 17B is a side view of the locking mechanism of FIG. 17A, in an unlocked configuration.
Figure 17C:
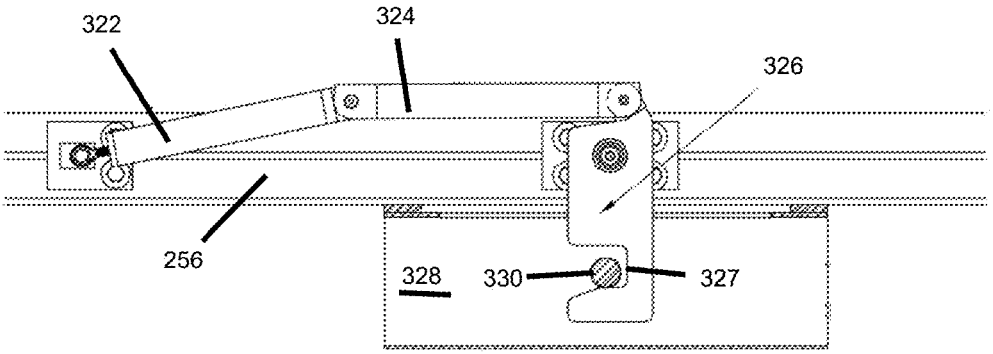
FIG. 17C is a side view of the locking mechanism of FIG. 17A, in a locked configuration.

Optionally, the door can be locked in the closed position using locking mechanism 320, shown in FIGS. 17A, 17B, and 17C. Locking the door in the closed position is important in some circumstances. In particular, in certain wind conditions the first door module 230 can rotate in an uncontrolled manner. By locking the door in the closed position, the uncontrolled movement of the first door module 230 can be prevented.

Locking mechanism 320 comprises an articulated arm 321 pivotally mounted to the lower arch 256 of the second door module 250 at a first end, and a lock box 328 cast into the concrete pad on which the structure 100 is erected, for receiving a second end of articulated arm 321 and locking the second door module 250 in the closed position. When the second door module 250 is locked in the closed position, and safety catches 310 and 312 are engaged (as shown in FIG. 16), the first door module 230 is locked in place in the closed position as well.

Articulating arm 321 is shown in detail in FIG. 17A. Articulating arm 321 comprises a first arm 322, a second arm 324 and lock grab 326. A first end of first arm 322 is pivotally attached to arch 256. In particular, the first end of first arm 322 is attached to a pivot 323 that is bolted to arch 256. First arm 322 extends 10" from the first end to a second end, which is attached by a hinge to a first end of the second arm 324. Second arm 324 extends 10" from its first end to a second end that is attached to lock grab 326 by a hinge.

Lock grab 326 is a rectangular steel plate having a C-shaped cutout 327 formed in one side thereof. Lock grab 326 is hingedly attached to second arm 324 at one corner, and is also pivotally attached to arch 256. In particular, lock grab 326 pivots about a pivot that is bolted to arch 256.

Lock grab 326 is dimensioned to be received within lock box 328, which is a rectangular steel box having an opening in an upper surface thereof for receiving the lock grab 326. A cylindrical steel pin 330 extends through the interior of lock box 328 from one side thereof to the other. Cutout 327 is dimensioned to receive pin 330 when lock grab 326 moves into lock box 328.

Operation of the locking mechanism 320 can be understood with reference to FIG. 17B, which shows the locking mechanism 320 in an unlocked position, and FIG. 17C, which shows the locking mechanism 320 in a locked position. When the door 200 moves to the closed position, arch 256 makes contact with the concrete pad on which structure 100 is erected. Articulated arm 321 is attached to arch 256 such that lock grab 326 is adjacent to lock box 328 when arch 256 makes contact with the concrete pad. A user then pushes down on the second arm 324, causing articulated arm 321 to move into the closed position and in particular, lock grab 326 to rotate into lock box 328 and receive pin 330 within cutout 327. In this position, locking mechanism 320 holds second door module 250 in the closed position, which in turn holds first door module 230 in the closed position by way of the safety catches 310 and 312.

To open the door 200, a user pulls upward on second arm 324, causing lock catch 326 to rotate out of lock box 328 and release pin 330. The second door module 250 (and first door module 230) is then free to move upward toward the open position.

Figure 18A:
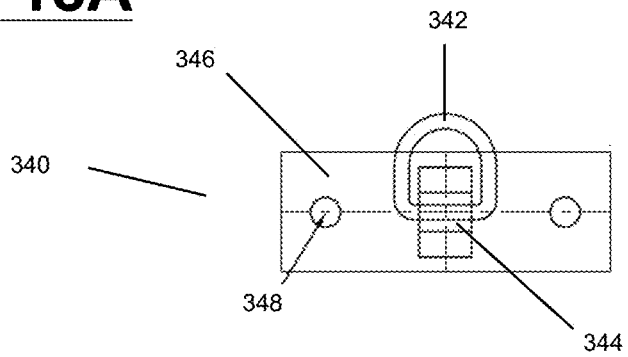
FIG. 18A is a plan view of an alternative locking mechanism for use with the door system of the present invention.
Figure 18B:
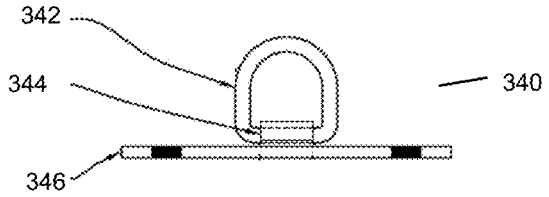
FIG. 18B is a side view of the alternative locking mechanism shown in FIG. 18A.

It will be apparent to those of skill in the art that alternative mechanisms are available for holding the door 200 in the closed position. Such alternative locking mechanisms can be used either in conjunction with, or in alternative to the locking mechanism 320, depending on the conditions in which the structure 100 is erected. An example alternative locking mechanism 340 is shown in FIGS. 18A and 18B. The alternative locking mechanism 340 comprises a ½-inch steel loop ring 342 fastened to a ⅝-inch steel plate 346 using a 3/16-inch steel loop bracket 344. The steel plate 346 is fastened to the concrete pad on which the structure 100 is erected using appropriate anchor bolts extending through bolt holes 348. To hold the door 200 in the closed position, the loop 342 can be hooked onto a hook-shaped flange (not shown) provided on arch 256 at a point such that the hook is adjacent to the loop 342 when the door 200 is in the closed position and the arch 256 is adjacent to the concrete pad.

The door opening system 300 can be controlled by digital logic. The digital control logic is in communication with encoder pack 219*a*, which generates an electronic signal based on the angular position of axle 218. This signal allows the digital control logic to know the current angular position of axle 218 and thus, the current position of the door modules 230, 250.

The digital control logic can be programmed to open the door in response to a single push of a button. While the door also can be closed with a single push of a button, this is not recommended for safety reasons. Rather, in preferred embodiments the user must be in constant contact with a button to close the door. In the event that said contact is broken, the movement of the door towards the close position stops.

The digital door control logic also can keep track of the number of times the door has been opened and closed. This can be useful for maintenance purposes, since the lifting cables may require replacement after a certain number of openings and closings of the door. In the illustrated embodiment, the lifting cables 302 will require replacement after approximately 5,000 cycles. The digital door control logic can provide an alert when a threshold value of cycles has been reached, and replacement of the lifting cables is required.

The foregoing is a description of particular example embodiments of the claimed invention. It will be understood by those of ordinary skill in the art that numerous modifications, substitutions, additions or omissions to the embodiments described above are possible, all of which are intended to fall within the scope of the claimed invention. The invention is not intended to be limited to the particular embodiments described above, but is defined by the attached claims, which are to be given the broadest possible scope consistent with this specification.

The invention claimed is:

1. A door system for a movable structure, the movable structure comprising a plurality of spaced apart frame members and at least one tensioned structure membrane extending between at least two of the spaced apart frame members and forming an interior space under the spaced apart frame members, the interior space having at least one open end, the door system comprising:

first and second axles arranged coaxially and attached to the structure at first and second sides of the open end of the interior space;

a first door module comprising:

a first frame extending from a first end of the first frame hingedly attached to the first axle, to a second end of the first frame hingedly attached to the second axle; and a first tensioned door membrane, separate from the tensioned structure membranes, supported by the first frame, wherein the first tensioned door membrane is stretched taut between the frame of the first door module; and a second door module comprising:

a second frame extending from a first end of the second frame hingedly attached to the first axle adjacent to the first end of the first frame, to a second end of the second frame hingedly attached to the second axle adjacent to the second end of the first frame; and a second tensioned door membrane, separate from the tensioned structure membranes, supported by the second frame, wherein the second tensioned door membrane is stretched taut between the frame of the second door module;

the first and second door modules being rotatable about the first and second axles between a closed position in which the first door module extends across an upper portion of the open end and the second door module extends across a lower portion of the open end, and an open position in which the open end of the interior space is substantially unobstructed by the first and second door modules, and in which the second door module is nested under the first door module in the open position and the second door module is not nested under the first door module in the closed position.

2. The system of claim 1, further comprising a system for rotating the first and second door modules about the first and second axes.

3. The system of claim 2, wherein the system for rotating comprises at least one cable attached at one end to the second door module, and at the other end to a winch for selectively extending or retracting the cable and raising or lowering the second door module.

4. The system of claim 1, further comprising a cable extending from a first cable end attached to the first door module to a second cable end attached to one of the plurality of spaced apart frame members, the cable being adapted to hold the first door module in its closed position extending across the upper portion of the open end of the interior space.

5. The system of claim 4, wherein the first and second door modules are adapted to make contact with each other when the second door module is being rotated from the closed position to the open position, to move the first door module from the closed position to the open position.

6. The system of claim 5, wherein a plurality of arms extend from the first door module, the plurality of arms being adapted to make contact with the second door module when the second door module is being rotated from the closed position to the open position, to move the first door module from the closed position to the open position.

7. The system of claim 1, wherein the first and second door modules are rotatable about the first and second axles to a partially open position wherein the second door module extends across the upper portion of the open end, and the lower portion of the open end is substantially unobstructed by the second door module.

8. The system of claim 1, wherein the first and second frames each comprise a plurality of arch members extending from the first end of the frame to the second end of the frame, the plurality of arch members being spaced apart between the first and second ends, wherein at least one of the plurality of arch members is parallel to the movable structure, the first and second frames each further comprising a plurality of spreader members disposed within the interior space of the movable structure and extending between the plurality of arch members to define at least one triangular region formed by the plurality of arch members, the plurality of frame members and the at least one tensioned structure membrane, wherein the at least one triangular region is fixedly attached to the movable structure.

9. The system of claim 8, wherein the first and second frames further comprise a plurality of cross spreader members extending substantially diagonally between connections points between the arch members and the spreader members.

10. The system of claim 1, further comprising a locking mechanism for holding the first and second door modules in the closed position.

11. The system of claim 10, wherein the locking mechanism comprises an articulated arm pivotally mounted to the second door module, the articulated arm being adapted to make contact with an attachment point in a surface on which the movable structure is erected, for holding the second door module in the closed position.

12. The system of claim 11, further comprising a pair of catches, one of said pair of catches provided on each of the first door module and second door module, the catches adapted to interlock with one another and hold the first door module in the closed position when the second door module is in the closed position.

13. A kit of parts for a door system for a movable structure, the movable structure comprising a plurality of spaced apart frame members and at least one tensioned structure membrane extending between at least two of the spaced apart frame members and forming an interior space under the spaced apart frame members, comprising:

first and second door membranes;

a first frame for supporting a first tensioned door membrane, the first frame extending from a first end of the first frame to a second end of the first frame;

a second frame for supporting a second tensioned door membrane, the second frame extending from a first end of the second frame to a second end of the second frame, wherein a distance from the first end of the second frame to the second end of the second frame is less than a distance from the first end of the first frame to the second end of the first frame;

wherein the first and second door membranes are separate from the first and second tensioned structure membranes, respectively, and the first and second tensioned door membranes are to be tensioned and supported by the first and second frames and stretched taut between the first and second frames, respectively;

wherein the first and second frames each comprise a plurality of arch members extending from the first end of the frame to the second end of the frame, the plurality of arch members being spaced apart between the first and second ends, at least one of the plurality of arch members is parallel to the movable structure, the first and second frames each further comprising a plurality of crossbar members disposed within an interior space of the movable structure and extending between the plurality of arch members to define at least one triangular region formed by the plurality of arch members, the plurality of frame members and at least one tensioned structure membrane, wherein the at least one triangular region is fixedly attached to the movable structure; and first and second axles for hingedly supporting the first and second ends, respectively of the first and second frames in an open position and a closed position, and wherein the second frame is nested under the first frame in the open position and the second frame is not nested under the first frame in the closed position.

14. The kit of claim 13, further including at least one lifting cable and winch, the lifting cable for attachment at one end to the second frame and an opposite end to the winch, the winch for selectively extending or retracting the lifting cable to raise or lower the second frame.

15. The kit of claim 14, further comprising at least one cable for attachment at one end to the first frame and at an opposite end of the cable to the movable structure.

16. The kit of claim 15, wherein the first frame further comprises an arm adapted to make contact with the second frame while the second frame is in motion, to move the first frame.

17. The kit of claim 13, wherein the first and second frames each further comprise a plurality of cross spreader members extending substantially diagonally between connection points between the arch members and the spreader members.

18. The kit of claim 13, wherein the second frame comprises an articulated arm pivotally mounted thereon, the articulated arm being adapted to make contact with an attachment point, for holding the second frame adjacent to the attachment point.

19. The kit of claim 13, wherein the first and second frames each comprise one of a pair of catches adapted to interlock with one another and hold the first and second frames adjacent to one another.

* * * * *